US008148038B2

(12) United States Patent
Fujiwara et al.

(10) Patent No.: US 8,148,038 B2
(45) Date of Patent: Apr. 3, 2012

(54) IMAGE BEARING MEMBER, PROCESS CARTRIDGE, IMAGE FORMING APPARATUS AND METHOD OF FORMING IMAGE BEARING MEMBER

(75) Inventors: Yukio Fujiwara, Numazu (JP); Tetsuro Suzuki, Fuji (JP); Hiroshi Tamura, Susono (JP); Hiroshi Ikuno, Yokohama (JP); Hidetoshi Kami, Numazu (JP); Takafumi Iwamoto, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 933 days.

(21) Appl. No.: 12/166,924

(22) Filed: Jul. 2, 2008

(65) Prior Publication Data

US 2009/0148180 A1 Jun. 11, 2009

(30) Foreign Application Priority Data

Jul. 2, 2007 (JP) ..... 2007-174534

(51) Int. Cl.
*G03G 5/00* (2006.01)

(52) U.S. Cl. ..... 430/66; 430/132; 399/159

(58) Field of Classification Search ..... 430/66, 430/132; 399/159
See application file for complete search history.

(56) References Cited

U.S. PATENT DOCUMENTS

| | | | |
|---|---|---|---|
| 4,772,525 | A | 9/1988 | Badesha et al. |
| 4,806,443 | A | 2/1989 | Yanus et al. |
| 5,030,532 | A | 7/1991 | Limburg et al. |
| 5,155,200 | A | 10/1992 | Limburg et al. |
| 5,322,753 | A | 6/1994 | Tamura et al. |
| 5,356,743 | A | 10/1994 | Yanus et al. |
| 5,488,137 | A | 1/1996 | Tamura et al. |
| 5,492,784 | A | 2/1996 | Yoshikawa et al. |
| 5,608,010 | A | 3/1997 | Tamura et al. |
| 5,871,876 | A | 2/1999 | Ikuno et al. |
| 6,030,733 | A | 2/2000 | Kami et al. |
| 6,066,428 | A | 5/2000 | Katayama et al. |
| 6,151,468 | A | 11/2000 | Kami et al. |
| 6,194,535 | B1 | 2/2001 | Katayama et al. |
| 6,210,848 | B1 | 4/2001 | Nagai et al. |
| 6,432,596 | B2 | 8/2002 | Ikuno et al. |
| 6,686,114 | B2 | 2/2004 | Sakon et al. |
| 6,861,188 | B2 | 3/2005 | Ikegami et al. |
| 6,998,209 | B2 | 2/2006 | Ikuno et al. |
| 7,175,957 | B2 | 2/2007 | Suzuki et al. |
| 7,179,573 | B2 | 2/2007 | Suzuki et al. |
| 7,189,487 | B2 | 3/2007 | Ikuno et al. |
| 7,251,437 | B2 | 7/2007 | Tamoto et al. |
| 7,267,916 | B2 | 9/2007 | Sugino et al. |
| 7,279,260 | B2 | 10/2007 | Nagai et al. |
| 7,314,693 | B2 | 1/2008 | Ikegami et al. |
| 7,315,722 | B2 | 1/2008 | Kitajima et al. |

(Continued)

FOREIGN PATENT DOCUMENTS

| | | |
|---|---|---|
| JP | 52-36016 | 3/1977 |

(Continued)

*Primary Examiner* — Mark Chapman
(74) *Attorney, Agent, or Firm* — Cooper & Dunham LLP

(57) ABSTRACT

An image bearing member including an electroconductive substrate, a charge generating layer located overlying the electroconductive substrate, a charge transport layer located overlying the charge generating layer, the charge transport layer comprising a charge transport material and a protective layer having a thickness of from 3 to 15 μm located overlying the charge transport layer, wherein the density of the charge transport material in the protective layer at depth of 2 μm from the surface of the charge transport layer satisfies the following relationship:

10(%)≦(Charge transport material)/{(Radical polymerizable monomer having a charge transport structure)+(Radical polymerizable monomer having no charge transport structure)+(Charge transport material)}×100≦30(%).

12 Claims, 4 Drawing Sheets

U.S. PATENT DOCUMENTS

| | | | |
|---|---|---|---|
| 7,341,814 | B2 | 3/2008 | Kami et al. |
| 7,348,113 | B2 | 3/2008 | Shoshi et al. |
| 7,361,438 | B2 | 4/2008 | Suzuki et al. |
| 7,381,511 | B2 | 6/2008 | Ikegami et al. |
| 2005/0158641 | A1 | 7/2005 | Yanagawa et al. |
| 2005/0158644 | A1 | 7/2005 | Kondo et al. |
| 2005/0175911 | A1 | 8/2005 | Tamoto et al. |
| 2005/0221210 | A1 | 10/2005 | Suzuki et al. |
| 2005/0238987 | A1 | 10/2005 | Ohshima et al. |
| 2005/0266325 | A1 | 12/2005 | Yanagawa et al. |
| 2005/0266328 | A1 | 12/2005 | Yanagawa et al. |
| 2005/0282075 | A1 | 12/2005 | Ikuno et al. |
| 2005/0287452 | A1 | 12/2005 | Tamura et al. |
| 2005/0287465 | A1 | 12/2005 | Ohshima et al. |
| 2006/0014093 | A1 | 1/2006 | Li et al. |
| 2006/0014096 | A1 | 1/2006 | Ohshima et al. |
| 2006/0051689 | A1 | 3/2006 | Suzuki et al. |
| 2006/0068308 | A1 | 3/2006 | Ohshima et al. |
| 2006/0093955 | A1 | 5/2006 | Ohshima et al. |
| 2006/0110668 | A1 | 5/2006 | Kawasaki et al. |
| 2006/0160003 | A1 | 7/2006 | Nagai et al. |
| 2006/0177749 | A1 | 8/2006 | Tamoto et al. |
| 2007/0009818 | A1 | 1/2007 | Yanagawa et al. |
| 2007/0031746 | A1 | 2/2007 | Toshine et al. |
| 2007/0154825 | A1 | 7/2007 | Tamoto et al. |
| 2007/0196749 | A1 | 8/2007 | Inaba et al. |
| 2007/0196750 | A1 | 8/2007 | Fujiwara et al. |
| 2007/0212625 | A1 | 9/2007 | Suzuki et al. |
| 2007/0212626 | A1 | 9/2007 | Toshine et al. |
| 2007/0212627 | A1 | 9/2007 | Yanagawa et al. |
| 2007/0231720 | A1 | 10/2007 | Mori et al. |
| 2007/0269729 | A1 | 11/2007 | Ikuno et al. |
| 2007/0292780 | A1 | 12/2007 | Nagai et al. |
| 2008/0020305 | A1 | 1/2008 | Suzuki et al. |
| 2008/0085459 | A1 | 4/2008 | Kami et al. |

FOREIGN PATENT DOCUMENTS

| | | |
|---|---|---|
| JP | 56-48637 | 5/1981 |
| JP | 63-285552 | 11/1988 |
| JP | 64-1728 | 1/1989 |
| JP | 64-9964 | 1/1989 |
| JP | 64-13061 | 1/1989 |
| JP | 64-19049 | 1/1989 |
| JP | 1-241559 | 9/1989 |
| JP | 4-11627 | 1/1992 |
| JP | 4-175337 | 6/1992 |
| JP | 4-183719 | 6/1992 |
| JP | 4-225014 | 8/1992 |
| JP | 4-230767 | 8/1992 |
| JP | 4-281461 | 10/1992 |
| JP | 4-320420 | 11/1992 |
| JP | 5-19497 | 1/1993 |
| JP | 5-70595 | 3/1993 |
| JP | 5-60503 | 9/1993 |
| JP | 5-232727 | 9/1993 |
| JP | 5-310904 | 11/1993 |
| JP | 6-45770 | 6/1994 |
| JP | 6-234836 | 8/1994 |
| JP | 6-234837 | 8/1994 |
| JP | 6-234838 | 8/1994 |
| JP | 6-234839 | 8/1994 |
| JP | 6-234840 | 8/1994 |
| JP | 6-234841 | 8/1994 |
| JP | 6-236050 | 8/1994 |
| JP | 6-236051 | 8/1994 |
| JP | 6-239049 | 8/1994 |
| JP | 6-295077 | 10/1994 |
| JP | 7-56374 | 3/1995 |
| JP | 8-176293 | 7/1996 |
| JP | 8-208820 | 8/1996 |
| JP | 8-211640 | 8/1996 |
| JP | 8-253568 | 10/1996 |
| JP | 8-269183 | 10/1996 |
| JP | 9-43883 | 2/1997 |
| JP | 9-62019 | 3/1997 |
| JP | 9-71642 | 3/1997 |
| JP | 9-87376 | 3/1997 |
| JP | 9-104746 | 4/1997 |
| JP | 9-110974 | 4/1997 |
| JP | 9-110976 | 4/1997 |
| JP | 9-157378 | 6/1997 |
| JP | 9-221544 | 8/1997 |
| JP | 9-227669 | 9/1997 |
| JP | 9-235367 | 9/1997 |
| JP | 9-241369 | 9/1997 |
| JP | 9-268226 | 10/1997 |
| JP | 9-272735 | 10/1997 |
| JP | 9-302084 | 11/1997 |
| JP | 9-302085 | 11/1997 |
| JP | 9-328539 | 12/1997 |
| JP | 10-73944 | 3/1998 |
| JP | 3164426 | 3/2001 |
| JP | 2004-302451 | 10/2004 |
| JP | 2006-138956 | 6/2006 |

IMAGE BEARING MEMBER, PROCESS CARTRIDGE, IMAGE FORMING APPARATUS AND METHOD OF FORMING IMAGE BEARING MEMBER

BACKGROUND OF THE INVENTION

1. Field of the Invention

The present invention relates to an image bearing member, an image formation method, a process cartridge and an image forming apparatus.

2. Discussion of the Background

In recent years, an organic photoconductor (OPC) has superseded an inorganic photoconductor in a photocopier, a facsimile machine, a laser printer and a multiple functional device thereof as an image bearing member in light of good performance and various kinds of advantages. For example, such an organic photoconductor has the following advantages over an inorganic photoconductor: (1) a wide light absorption wavelength range and a large light absorption amount with regard to optical characteristics; (2) high sensitivity and stable chargeability with regard to electric characteristics; (3) wide selection range of materials; (4) easiness of manufacturing; (5) low cost; and (6) non-toxic.

On the other hand, along with the recent advance of size reduction of an image forming apparatus, the image bearing member therein has been also reduced in size. Furthermore, due to movement toward high speed performance and maintenance-free, an image bearing member having a high durability has been strongly demanded. From this point of view, an organic photoconductor is generally soft considering that the main components of the surface layer thereof are a low molecular weight charge transport material and an inactive polymer. Therefore, when such an organic photoconductor is repetitively used in the electrophotographic process, the organic photoconductor has a disadvantage of being easily abraded under the mechanical stress caused by a development system or a cleaning system. In addition, to meet the demand of producing quality images, the size of toner particles decreases, which requires improvement of cleaning property. Thus, the hardness of rubber of a cleaning blade and the contact pressure thereof to an image bearing member increase. This results in another factor of accelerating the abrasion of the surface of an image bearing member. Such abrasion of the image bearing member invites deterioration of electric characteristics such as sensitivity and chargeability and causes reduction of image density, background fouling, etc., which leads to production of abnormal images. When such abrasion occurs locally and damages the surface of an image bearing member, obtained images have streak fouling. In the current situation, the working life of an image bearing member is limited by this abrasion or scar, meaning that replacement of the image bearing member is necessary. With regard to improvement on the durability of an organic photoconductor (image bearing member), reducing the amount of the abrasion described above is inevitable and an imminent problem to be solved in this field.

There are following technologies for improving the anti-abrasion property of a photosensitive layer: (1) using a surface layer containing a curing binder resin {refer to unexamined published Japanese patent application No. (hereinafter referred to as JOP) S56-48637}; (2) using a charge transfer polymer (refer to JOP S64-1728); and (3) using a surface layer in which an inorganic filler is dispersed (refer to JOP H04-281461).

Even an image bearing member having a cross-linking photosensitive layer in which a charge transport structure is formed by chemical bonding in the related technologies does not have sufficient properties in total.

JOP 2004-302451 describes a technology by which the drawbacks described above are significantly improved by forming the protective layer of an image bearing member by curing a radical polymerizable monomer having at least 3 functional groups with no charge transport structure and a radical polyemrizable compound having one functional group with a charge transport structure.

On the other hand, along with an increasing advance of the electrophotographic technology in recent years, the image bearing member has been demanded to have excellent characteristics. For example, producing monochrome images such as characters used to be the main function but the demand for producing color images such as photographs and the image quality thereof have been increasing these days.

However, when the image bearing member described above is used for a color electrophotographic apparatus or an electrophotographic apparatus without using discharging light, the drawbacks such as residual images, residual voltage, and a rise of voltage after irradiation occur. Especially, an image bearing member that is used for an electrophotographic apparatus without using discharging light produces images with an apparent residual image from the beginning.

The residual image tends to appear in a half tone image. Since a color image tend to be fanned by overlapping halftone images, the residual image creates a significant problem. Furthermore, the degree of a residual image color by color in the case of a color image is the same as that of a monochrome image but since the multiple color images are superimposed atop, the residual image easily stands out.

As a method of controlling such a residual image, there is a method of providing a discharging device for pre-irradiation to an image forming apparatus (electrophotographic device). However, in light of cost reduction and size reduction of the main body of an image forming apparatus, such a discharging device is not provided in many cases.

Although the anti-abrasion property of an image bearing member is improved due to the technologies described above, with an increasing demand for quality images and high durability, an image forming apparatus having an excellent combination of the image stability and the anti-abrasion property has been desired.

SUMMARY OF THE INVENTION

Because of these reasons, the present inventors recognize that a need exists for an image bearing member which is excellent in reducing and preventing the occurrence of residual images even when the image bearing member is installed in a color image forming apparatus without a discharging device, and also for a process cartridge and an image forming apparatus having the image bearing member. It is to be noted that, in this specification, the image bearing member is an electrographic photoreceptor for carrying a latent electrostatic image.

Accordingly, an object of the present invention is to provide an image bearing member which is excellent in reducing and preventing the occurrence of residual images even when the image bearing member is installed in a color image forming apparatus without a discharging device, and also a process cartridge and an image forming apparatus having the image bearing member.

Briefly this object and other objects of the present invention as hereinafter described will become more readily apparent and can be attained, either individually or in combination thereof, by an image bearing member including an electroconductive substrate, a charge generating layer located overlying the electroconductive substrate, a charge transport layer located overlying the charge generating layer, the charge transport layer comprising a charge transport material; and a protective layer having a thickness of from 3 to 15 μm located overlying the charge transport layer, wherein the protective layer includes cross-linked material of a radical polymerizable monomer having a charge transport structure and a radical polymerizable monomer having no charge transport structure, and wherein the density of the charge transport material in the protective layer at a depth of 2 μm from a surface of the charge transport layer satisfies the following relationship (1): 10 (Charge transport material)/{(Radical polymerizable monomer having a charge transport structure)+(Radical polymerizable monomer having no charge transport structure)+(Charge transport material)}×100≦30 Relationship (1).

It is preferred that, in the image bearing member mentioned above, the protective layer is formed by application of a liquid application including the radical polymerizable monomer having a charge transport structure and the radical polymerizable monomer having no charge transport structure and curing of the liquid application by an optical energy irradiation device and the following relationship (2) is satisfied: 16<C/100×(T−Tg)×log 10t<75 Relationship (2), where T (° C.) represents a drying temperature in a range of from 100 to 160° C. after the protective layer is formed, t (min) represents a drying time in a range of from 30 to 240 minutes after the protective layer is formed, C (%) represents the content of the charge transport material at the surface of the charge transport layer in a range of from 33 to 70% by weight before the protective layer is formed, and Tg (° C.) represents a glass transition temperature of the charge transport layer.

It is still further preferred that, in the image bearing member mentioned above, the protective layer includes a phosphorous based anti-oxidizing agent.

It is still further preferred that, in the image bearing member mentioned above, the radical polymerizable monomer having no charge transport structure for use in formation of the protective layer has at least three radical polymerizable functional groups.

It is still further preferred that, in the image bearing member mentioned above, wherein the radical polymerizable monomer having a charge transport structure for use in formation of the protective layer has one radical polymerizable functional group.

It is still further preferred that, in the image bearing member mentioned above, the radical polymerizable monomer having a charge transport structure and the radical polymerizable monomer having no charge transport structure have an acryloyloxy group or a methacryloyloxy group as the radical polymerizable functional group thereof.

It is still further preferred that, in the image bearing member mentioned above, only the radical polymerizable monomer having a charge transport structure has a charge transport structure in the liquid application.

As another aspect of the present invention, an image formation is provided which includes charging the image bearing member mentioned above, irradiating the image bearing member to form a latent electrostatic image thereon, developing the latent electrostatic image to form a developed image with a developing agent and transferring the developed image to a recording medium.

As another aspect of the present invention, an image forming apparatus is provided which includes the image bearing member mentioned above, a charging device to charge the image bearing member, an irradiation device to irradiate the image bearing member with light to form a latent electrostatic image thereon, a developing device to develop the latent electrostatic image with a developing agent to form a developed image, a transferring device to transfer the developed image to a recording medium.

As another aspect of the present invention, a process cartridge is provided which includes the image bearing member mentioned above, and at least one device selected from the group consisting of a charging device, a developing device, a cleaning device and a transfer device.

As another aspect of the present invention, a method of forming an image bearing member is provided which includes forming a charge generating layer located overlying an electroconductive substrate, forming a charge transport layer located overlying the charge generating layer, the charge transport layer including a charge transport material, and faulting a protective layer having a thickness of from 3 to 15 μm located overlying the charge transport layer by application of a liquid application including a radical polymerizable monomer having a charge transport structure and a radical polymerizable monomer having no charge transport structure and curing of the liquid application by an optical energy irradiation device, wherein the density of the charge transport material in the protective layer at a depth of 2 μm from the surface of the charge transport layer satisfies the following relationship (1): 10≦(Charge transport material)/{(Radical polymerizable monomer having a charge transport structure)+(Radical polymerizable monomer having no charge transport structure)+(Charge transport material)}×100≦30 Relationship (1), and wherein the following relationship (2) is satisfied: 16<C/100×(T−Tg)×log 10t<75 Relationship (2), where T (° C.) represents a drying temperature in a range of from 100 to 160° C. after the protective layer is formed, t (min) represents a drying time in a range of from 30 to 240 minutes after the protective layer is formed, C (%) represents a content of the charge transport material at the surface of the charge transport layer in a range of from 33 to 70% by weight before the protective layer is formed, and Tg (° C.) represents a glass transition temperature of the charge transport layer.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
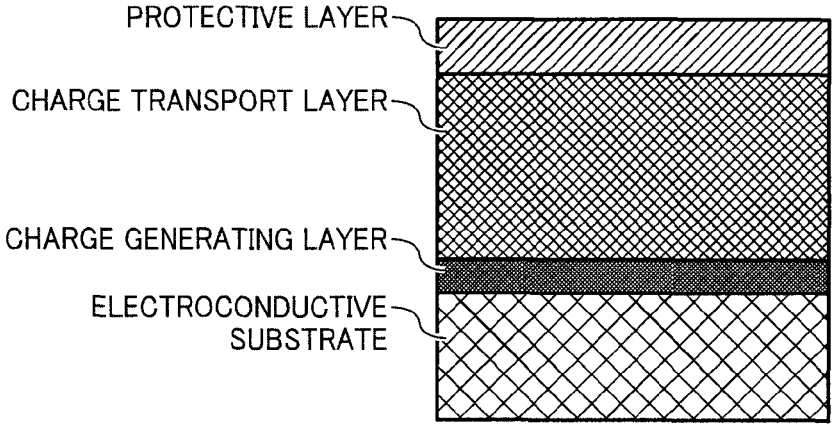
FIG. 1 is a cross section illustrating an example of the image bearing member of the present invention.

The present invention will be described below in detail with reference to several embodiments and accompanying drawings.

In the image bearing member (photoreceptor) of the present invention in which a charge generating layer, a charge transport layer and a protective layer are accumulated on an electroconductive substrate in this order, the charge transport layer has a charge transport material. The protective layer includes cross-linked material of a radical polymerizable monomer having a charge transport structure and a radical polymerizable monomer having no charge transport structure and has a layer thickness of from 3 to 15 μm and preferably from 4 to 15 μm and the density (weight %) of the charge transport material in the protective layer at a depth of 2 μm from the surface of the charge transport layer satisfies the following relationship about the weight: 10≦(Charge transport material)/{(Radical polymerizable monomer having a charge transport structure)+(Radical polymerizable monomer having no charge transport structure)+(Charge transport material)}×100≦30. That is, the weight of the charge transport material against the total weight of the radical polymerizable monomer having a charge transport structure, the radical polymerizable monomer having no charge transport structure and the charge transport material is from 10 to 30% by weight. It is found that an excellent combination of image stability and anti-abrasion property is obtained by using such an image bearing member. It is preferred that the protective layer is formed by applying a liquid application containing at least a radical polymerizable monomer having a charge transport structure and a radical polymerizable monomer having no charge transport structure followed by curing with a light energy irradiation device. It is also preferred that the radical polymerizable monomer having a charge transport structure is the only compound having a charge transport structure in the liquid application.

Reduction of Residual Image

It is known that a typical cross linking protective layer, which is formed of a radical curing composition, forms a dense three-dimensional network structure, thereby obtaining a high anti-abrasion property. However, as described in JOP 2004-302451, there is a problem for an image bearing member having a protective layer formed of a radical polymerizable having a charge transport structure and a radical polymerizable compound having no charge transport structure provided on a charge transport layer formed of a thermoplastic resin in that apparent residual images occur from the beginning due to the following reason. That is, since a radical polymerizable monomer having a charge transport structure is fixed in the protective layer through a cross linking reaction, the latitude of the movability of the main chain or the cross linking chain of the polymer in the protective layer decreases so that the charge is not smoothly given or received from the charge transport layer to the protective layer, resulting in trap of the charge at the interface between the charge transport layer and the protective layer.

JOP 2006-138956 describes a technology in which a charge transport material contained in the charge transport layer is contained in the protective layer. However, when a charge transport compound is contained in a liquid application for a protective layer beforehand, the charge transport compound absorbs ultraviolet light required for cross linking, resulting in insufficient curing. Consequently, the anti-abrasion property of the protective layer is insufficient. To compensate this insufficient curing, it is possible to irradiate the protective layer with ultraviolet for an extended period of time. However, this causes a problem that the charge transport compound deteriorates due to ultraviolet, thereby worsening the electronic characteristics of the image bearing member.

By contrast, in the present invention, a charge transport material contained in the charge transport layer is migrated into the protective layer after the cross linking reaction. Therefore, residual images do not occur and thus a high image stability and a high anti-abrasion property are obtained. The mechanism of reducing the occurrence of residual images is not clear but is inferred as follows:

Since the charge transport compound contained in the charge transport layer also exists in the protective layer, the probability of giving and receiving of the charge between the same charge transport compounds increases and the trapped charge causing residual images is smoothly transferred to the protective layer. In addition, it is inferred that, by the migration after the cross linking reaction, the charge transport compound contained in the charge transport layer enters into the gap in the network of the three-dimensional cross linking layer. Therefore, the anti-abrasion property does not deteriorate unlike a case in which a charge transport compound is preliminarily added, thereby reducing the anti-abrasion property due to the cross-linking inhibition.

The density of the charge transport compound in the protective layer can be measured by Raman spectroscopic method, Attenuated Total Reflection (ATR) of Fourier transform infrared spectroscopy (FT-IR), etc. A measuring example of Fourier transform infrared spectroscopy is described below: First, analytical curve is made as follows: For a sample analytical curve, a layer having a thickness of about 5 μm containing a particular amount of polymethylmethacrylate (PMMA), a radical polymerizable monomer having a charge transport structure and a particular amount of a charge transport material is formed; The surface of the layer is measured by ATR method of FT-IR; and the analytical curve is formed by using the intensity ratio between the absorption (carbonyl) of PMMA and the absorption of the charge transport material (e.g., mono-substituted benzene, di-substituted benzene); After the analytical curve is made, when an actual sample is measured, the carbonyl equivalent weight contained in the actual sample is converted into the carbonyl equivalent weight of the sample analytical curve and the content of the charge transport material of the charge transport layer contained in the protective layer is measured.

Protective Layer at Depth of 2 μm from Surface of Charge Transport Layer

The protective layer at a depth of 2 μm from the interface to the charge transport layer can be obtained by abrading the surface of the image bearing member to which the protective layer is provided. For example, using a wrapping film (manufactured by Sumitomo 3M), an electroconductive substrate on which a protective layer is formed is rotated at a constant speed and a wrapping film is made in contact therewith for abrasion. Whether the remaining thickness of the protective layer of an image bearing member is 2 μm can be determined by using an eddy-current thickness measuring device (manufactured by Fisher Instrument Company) from the layer thickness before and after the protective layer is formed and abraded.

Relationship (2)

The image bearing member of the present invention can be advantageously manufactured by satisfying the following relationship (2): $16<C/100\times(T-Tg)\times\log_{10} t<75$. In the relationship (2), T (° C.) represents a drying temperature in a range of from 100 to 160° C. after the protective layer is formed, t (min) represents a drying time in a range of from 30 to 240 minutes after the protective layer is formed, C (%)

represents the content of the charge transport material at the surface of the charge transport layer in a range of from 33 to 70% by weight on the charge transport layer before the protective layer is formed, and Tg (° C.) represents a glass transition temperature of the charge transport layer. Soaking (Migration) of the charge transport material of the charge transport layer to the protective layer after the cross linking reaction is complete mainly due to the heat diffusion of the charge transport material. Therefore, as the drying temperature after the formation of the surface layer is high and the drying time extends, the heat diffusion increases. Furthermore, as the content of the charge transport material at the surface of the charge transport layer increases, the amount of soaking (migration) of the charge transport material to the protective layer caused by heat diffusion increases. In addition, the binder resin contained in the charge transport layer also contributes to the heat diffusion of the charge transport material. Thus, a charge transport material that has a low glass transition point easily causes the heat diffusion.

Although the mechanism described above is not clear, since the parameters described above are interrelated mutually, when the relationship (2) is satisfied, the density of the charge transport material in the protective layer is not less than 10% at a depth of 2 bun from the surface of the charge transport layer, thereby improving the effect of reducing the occurrence of residual image. When $C/100\times(T-Tg)\times\log_{10} t$ is less than 16, the movement of the charge due to heat diffusion tends to be inactive and the density of the charge transport material at a depth of 2 μm from the surface of the charge transport layer is lower than 10%. Consequently, the occurrence of residual images it not reduced. When $C/100\times(T-Tg)\times\log_{10} t$ is greater than 75, the drying temperature tends to be high, the drying time tends to be extended, and/or the glass transition temperature tends to be low. In this case, problems arise such that the electric characteristics of the image bearing member deteriorates due to the heat, and a portion of the charge transport layer to the protective layer is peeled off in the image formation process because the content of the charge transport material is excessive.

Density of Charge Transport Material at Charge Transport Layer Before Protective Layer is Formed The density of the charge transport material at the surface of the charge transport layer before the protective layer is formed can be measured by the same method as described in the method for measuring the density of the charge transport material in the protective layer, i.e., Raman spectroscopic method, ATR of Fourier transform infrared spectroscopy (FT-IR), etc. Using a layer having a thickness of about 5 μm containing a binder resin and a particular amount of a charge transport material, an analytical curve is made from the intensity ratio between the sole peak of the charge transport material and the sole peak of the binder resin. From the analytical curve, the density of the charge transport material before the protection layer is formed can be measured.

Next, the radical polymerizable compound for use in the present invention is described.

Radical Polymerizable Monomer Having Charge Transport Structure

As the radical polymerizable compound for use in the present invention, a compound having a charge transport structure is suitably used. Specific examples of the radical polymerizable compound having a charge transport structure for use in the present invention include a compound having a radical polymerizable functional group with, for example, a positive hole transport structure, for example, triarylamine, hydrazone, pyrazoline, and carbazole, and/or an electron-transport structure, for example, electron-sucking aromatic ring having condensed polycyclic quinone, diphenoquinone, cyano group, and nitro group. Any radical polymerizable functional group having a carbon-carbon double bond is acceptable as the radical polymerizable functional group.

Specific examples of these radical polymerizable functional groups include, but are not limited to, 1-ethylene substituted functional groups, and 1,1-substituted ethylene functional groups as follows:

Specific examples of the 1-substituted ethylene functional group include, but are not limited to, functional groups represented by the following chemical structure (1): $CH_2{=}CH{-}X_1{-}$ Chemical structure (1).

In the chemical structure (1), $X_1$ represents a substituted or non-substituted arylene group, for example, phenylene group, or naphthylene group, a substituted or non-substituted alkenylene group, CO group, COO group, CON ($R_{10}$) group ($R_{10}$ represents a hydrogen atom, an alkyl group, for example, methyl group or ethyl group, or an aralkyl group, for example, benzyl group, naphthylmethyl group or phenethyl group, or an aryl group, for example, phenyl group or naphthyl group), or an S group.

Specific examples of these substituent groups include, but are not limited to, vinyl group, styryl group, 2-methyl-1,3-butadienyl group, vinylcarbonyl group, acryloyloxy group, acryloylamide group, and vinylthioether group.

Examples of the 1,1-substituted ethylene functional group include, but are not limited to, functional groups represented by the following chemical structure (2): $CH_2{=}CH(Y){-}X_2{-}$ Chemical structure (2)

In the chemical structure (2), Y represents a substituted or non-substituted alkyl group, a substituted or non-substituted aralkyl group, a substituted or non-substituted aryl group, for example, phenyl group and naphthyl group, a halogen atom, or an alkoxy group, for example, cyano group, nitro group, methoxy group or ethoxy group, $COOR_{11}$ ($R_{11}$ represents a hydrogen atom, a substituted or non-substituted alkyl group, for example, methyl group or ethyl group; a substituted or non-substituted aralkyl group, for example, benzyl group or phenethyl group, or a substituted or non-substituted aryl group, for example, phenyl group or naphthyl group), or $CONR_{12}R_{13}$ ($R_{12}$ and $R_{13}$ independently represent a hydrogen atom, a substituted or non-substituted alkyl group, for example, methyl group or ethyl group, a substituted or non-substituted aralkyl group, for example, benzyl group, naphthylmethyl group or phenethyl group, or a substituted or non-substituted aryl group, for example, phenyl group or naphthyl group. $X_2$ represents the same substituent group as $X_1$, a single bond or an alkylene group. At least either of Y and $X_2$ is an oxycarbonyl group, cyano group, an alkenylene group or an aromatic ring.

Specific examples of these substituent groups include, but are not limited to, α-acryloyloxy chloride group, methacryloyloxy group, α-cyanoethylene group, α-cyanoacryloyloxy group, α-cyanophenylene group, and methacryloylamino group.

Examples of substituent groups that are furthermore substituted in the substituent group of $X_1$, $X_2$, or Y include, but are not limited to, an alkyl group, for example, a halogen atom, nitro group, cyano group, methyl group or ethyl group; an alkoxy group, for example, methoxy group, and ethoxy group; an aryloxy group, for example, phenoxy group; an aryl group, for example, phenyl group and naphthyl group; and an aralkyl group, for example, benzyl group and phenethyl group.

Among these radical polymerizable functional groups, acryloyloxy group, and methacryloyloxy group are particularly effective, and a compound having one or more acryloyloxy groups can be obtained by conducting, for example, an ester reaction or an ester exchange reaction of a compound having one or more hydroxyl groups in the molecule, an acrylic acid (salt), an acrylic acid halide, and an acrylic acid ester. A compound having one or more methacryloyloxy groups can also be obtained in the same manner. The radical polymerizable functional groups in the monomer having two or more radical polymerizable functional groups may be the same or different from each other. Among these radical polymerizable functional groups, acryloyloxy group and methacryloyloxy group are useful in particular. The number of the radical polymerizable functional groups in a molecular can be one or more. However, to restrain the internal stress in a cross linking protective layer, obtain a smooth surface and sustain good electric characteristics, one radical polymerizable functional group is preferred in general. By using a charge transport compound having a radical polymerizable functional groups, the durability is further improved and the electric characteristics are stabilized for an extended period of time. As the charge transport structure of the charge transport compound having a radical polymerizable functional groups, the triaryl amine structure is suitable in terms of high mobility. Especially when the compounds represented by Chemical structures (3) and (4) are used, the electric characteristics such as sensitivity and the residual voltage are suitably sustained.

Chemical structure (3)

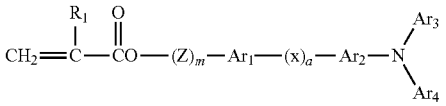

Chemical structure (4)

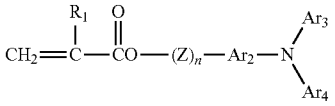

In the Chemical structures (3) and (4), $R_1$ represents hydrogen atom, a halogen atom, an alkyl group, an aralkyl group, an aryl group, a cyano group, a nitro group, an alkoxy group, —$COOR_7$, wherein $R_7$ represents hydrogen atom, a substituted or non-substituted alkyl group, a substituted or non-substituted aralkyl group or a substituted or non-substituted aryl group, a halogenated carbonyl group or $CONR_8R_9$, wherein $R_8$ and $R_g$ independently represent hydrogen atom, a halogen atom, a substituted or non-substituted alkyl group, a substituted or non-substituted aralkyl group or a substituted or non-substituted aryl group, $Ar_1$ and $Ar_2$ independently represent a substituted or unsubstituted arylene group, $Ar_3$ and $Ar_4$ independently represent a substituted or unsubstituted aryl group, X represents a substituted or non-substituted alkylene group, a substituted or non-substituted cycloalkylene group, a substituted or non-substituted alkylene ether group, oxygen atom, sulfur atom or vinylene group, Z represents a substituted or non-substituted alkylene group, a substituted or non-substituted alkylene ether divalent group or an alkyleneoxy carbonyl divalent group, a represents 0 or 1 and m and n represent 0 or an integer of from 1 to 3.

In the chemical structures (3) and (4), in the substitution group of $R_1$, specific examples of the alkyl groups include, but are not limited to, methyl group, ethyl group, propyl group, and butyl group; specific examples of the aryl groups include, but are not limited to, phenyl group and naphthyl group; specific examples of the aralkyl groups include, but are not limited to, benzyl group, phenethyl group and naphthylmethyl group; specific examples of the alkoxy group include, but are not limited to, methoxy group, ethoxy group, and propoxy group. These groups can be substituted by a halogen atom; nitro group; cyano group; an alkyl group, for example, methyl group and ethyl group; an alkoxy group, for example, methoxy group and ethoxy group; an aryloxy group, for example, phenoxy group; an aryl group, for example, phenyl group and naphthyl group; or an aralkyl group, for example, benzyl group and phenethyl group.

Among the substituent groups of $R_1$, hydrogen atom, and methyl group are particularly preferred.

Substituted or unsubstituted $Ar_a$ and $Ar_4$ are aryl groups, and specific examples thereof include, but are not limited to, condensed polycyclic hydrocarbon groups, non-condensed cyclic hydrocarbon groups, and heterocyclic groups.

Preferred specific examples of the condensed polycyclic hydrocarbon group include, but are not limited to, groups in which the number of the carbon atoms forming a ring is 18 or less. Specific examples thereof include, but are not limited to, pentanyl group, indenyl group, naphthyl group, azulenyl group, heptalenyl group, biphenylenyl group, as (asym)-indacenyl group, s(sym)-indacenyl group, fluorenyl group, acenaphthylenyl group, pleiadenyl group, acenaphtenyl group, phenalenyl group, phenanthryl group, anthryl group, fluoranthenyl group, acephenantolylenyl group, aceanthrylenyl group, triphenylel group, pyrenyl group, chrysenyl group and naphthacenyl group.

Specific examples of the uncondensed cyclic hydrocarbon groups include, but are not limited to, monovalent groups derived from benzene, diphenyl ether, polyethylene diphenyl ether, diphenyl thioether, diphenyl sulfone, biphenyl, polyphenyl, diphenyl alkane, diphenyl alkene, diphenyl alkyne, triphenylmethane, distyrylbenzene, 1,1-diphenyl cycloalkane, polyphenyl alkane, and polyphenyl alkene. In addition, monovalent groups derived from polycyclic hydrocarbons such as 9,9-diphenyl fluorene can also be used.

Specific examples of the heterocyclic groups include, but are not limited to, monovalent groups derived from carbazole, dibenzofuran, dibenzothiophene, oxadiazole, thiazole, etc.

The aryl groups represented by $Ar_3$ and $Ar_4$ may have the following substituent groups.

(1) A halogen atom, cyano group, nitro group, etc.

(2) A straight-chain or branched-chain alkyl group having 1 to 12 carbon atoms, more preferably 1 to 8 carbon atoms, and much more preferably 1 to 4 carbon atoms, which may substituted with fluorine atom; hydroxyl group; cyano group; an alkoxy group having 1 to 4 carbon atoms; or a phenyl group substituted with a halogen atom, an alkyl group having 1 to 4 carbon atoms, or an alkoxy group having 1 to 4 carbon atoms. Specific examples of the alkyl groups include, but are not limited to, methyl group, ethyl group, n-butyl group, i-propyl group, t-butyl group, s-butyl group, n-propyl group, trifluoromethyl group, 2-hydroxyethyl group, 2-ethoxyethyl group, 2-cyanoethyl group, 2-methoxyethyl group, benzyl group, 4-chlorobenzyl group, 4-methylbenzyl group, and 4-phenylbenzyl group.

(3) An alkoxy group (—$OR_2$, wherein $R_2$ represents an alkyl group defined in the paragraph (2)). Specific examples of the alkoxy groups include, but are not limited to, methoxy group, ethoxy group, n-propoxy group, i-propoxy group, t-butoxy group, n-butoxy group, s-butoxy group, i-butoxy group, 2-hydroxyethoxy group, benzyloxy group, and trifluoromethoxy group.

(4) An aryloxy group. Specific examples of the aryl groups include, but are not limited to, phenyl group and naphthyl group. The aryloxy group can be substituted with an alkoxy group having 1 to 4 carbon atoms, an alkyl group having 1 to 4 carbon atoms, or a halogen atom. Specific examples of the aryloxy groups include, but are not limited to, phenoxy group, 1-naphthyloxy group, 2-naphthyloxy group, 4-methoxyphenoxy group, and 4-methylphenoxy group.

(5) An alkylmercapto group or an arylmercapto group. Specific examples of these groups include, but are not limited to, methylthio group, ethylthio group, phenylthio group, and p-methylphenylthio group.

(6) A substituent group represented by the following chemical formula:

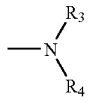

wherein each of $R_3$ and $R_4$ independently represents a hydrogen atom, an alkyl group defined in the paragraph (2), or an aryl group (e.g., phenyl group, biphenyl group, naphthyl group) which can be substituted with an alkoxy group having 1 to 4 carbon atoms, an alkyl group having 1 to 4 carbon atoms, or a halogen atom; and wherein $R_3$ and $R_4$ optionally share bond connectivity to form a ring. Specific examples of the substituent groups mentioned above include, but are not limited to, amino group, diethylamino group, N-methyl-N-phenylamino group, N,N-diphenylamino group, N,N-di(tolyl)amino group, dibenzylamino group, piperidino group, morpholino group, and pyrrolidino group.

(7) An alkylenedioxy group and an alkylenedithio group such as methylenedioxy group and methylenedithio group.

(8) A substituted or unsubstituted styryl group, a substituted or unsubstituted β-phenyl styryl group, diphenyl aminophenyl group, dinitrile aminophenyl group, etc.

Specific examples of the arylene groups represented by $Ar_1$ and $Ar_2$ include, but are not limited to, divalent groups derived from the aryl groups represented by $Ar_3$ and $Ar_4$.

X represents a single bond, a substituted or unsubstituted alkylene group, a substituted or unsubstituted cycloalkylene group, a substituted or unsubstituted alkylene ether group, an oxygen atom, a sulfur atom, or a vinylene group.

The substituted or unsubstituted alkylene group is a straight-chained or branched-chain alkylene group having 1 to 12 carbon atoms, preferably 1 to 8 carbon atoms, and more preferably 1 to 4 carbon atoms. These alkylene groups may have a fluorine atom, a hydroxyl group, a cyano group, an alkoxy group having 1 to 4 carbon atoms, a phenyl group, or a phenyl group substituted with a halogen atom, an alkyl group having 1 to 4 carbon atoms, or an alkoxy group having 1 to 4 carbon atoms. Specific examples of the substituted or unsubstituted alkylene groups include, but are not limited to, methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-mehoxyethylene group, benzylidene group, phenylethylene group, 4-chlorophenylethylene group, 4-methylphenylethylene group, and 4-biphenylethylene group.

The substituted or non-substituted cycloalkylene group is a cyclic alkylene group having 5 to 7 carbon atoms which may have a fluorine atom, a hydroxyl group, an alkyl group having 1 to 4 carbon atoms, or an alkoxy group having 1 to 4 carbon atoms. Specific examples of the substituted or non-substituted cycloalkylene groups include, but are not limited to, cyclohexylidene group, cyclohexylene group, and 3,3-dimethylcyclohexylidene group.

Specific examples of the substituted or non-substituted alkylene ether divalent groups include, but are not limited to, alkyleneoxy divalent groups such as ethyleneoxy group and propyleneoxy group, alkylene dioxy divalent groups derived from, for example, ethylene glycol and propylene glycol, di- or poly-(oxyalkylene)oxy divalent groups derived from, for example, diethylene glycol, tetraethylene glycol, and tripropylene glycol. The alkylene group of the alkylene ether divalent group may have a substituent group, for example, a hydroxyl group, a methyl group, and an ethyl group.

Specific examples of the vinylene groups include, but are not limited to, the following substituent groups:

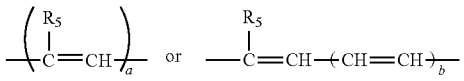

$R_5$ represents a hydrogen atom, an alkyl group (same as defined in the paragraph (2)), or an aryl group (same aryl groups as represented by $Ar_a$ and $Ar_4$); a represents an integer of 1 or 2; and b represents an integer of from 1 to 3.

Z represents a substituted or unsubstituted alkylene group, a substituted or non-substituted alkylene ether group, or an alkyleneoxycarbonyl divalent group.

Examples of the substituted or unsubstituted alkylene group include, but are not limited to, the same alkylene groups as those described in the X.

Examples of the substituted or non-substituted alkylene ether divalent group include, but are not limited to, the same alkylene ether groups as those described for the X.

Examples of the alkyleneoxycarbonyl divalent group include, but are not limited to, caprolactone-modified divalent groups.

As the charge transport compound having a radical polymerizable functional group for use in the present invention, compounds represented by the following chemical structure (5) are preferably used.

Chemical structure (5)

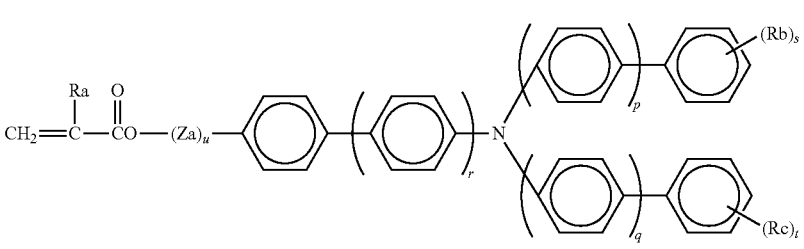

In the chemical structure (5), u, r, p, q represent 0 or 1, and t independently represent 0 or an integer of from 1 to 3, Ra represents hydrogen atom or methyl group, each of Rb and Rc independently represents an alkyl group having 1 to 6 carbon atoms, and Za represents methylene group, ethylene group, —$CH_2CH_2O$—, —$CHCH_3CH_2O$—, or —$C_6H_5CH_2CH_2$—.

Among the compounds represented by the chemical structure illustrated above, the compounds having a methyl group or an ethyl group as each of Rb and Rc are particularly preferred.

In addition, in the present invention, acrylates represented by Chemical structure 6 are also preferably used as the charge transport compounds having a radical polymerizable functional groups.

$B_1$—$Ar_5$—CH═CH—$Ar_6$—$B_2$ Chemical structure (6)

In the Chemical structure (6), $Ar_5$ represents a mono-valent group or divalent group having a substituted or non-substituted aromatic hydrocarbon skeleton. Specific examples of the aromatic hydrocarbons include, but are not limited to, benzene, naphthalene, phenanthrene, biphenyl, and 1,2,3,4-tetrahydronaphthalene.

Specific examples of the substituted groups include, but are not limited to, alkyl groups having 1 to 2 carbon atoms, alkoky groups having 1 to 12 carbon atoms, benzyl groups, halogen atoms. In addition, the alkyl groups and the alkoxy groups may have halogen atoms and/or phenyl groups as a substitution group.

$Ar_6$ represents a mono-valent group or divalent group having a aromatic hydrocarbon skeleton or a heterocyclic compound skeleton having at least one tertiary amino group. The aromatic hydrocarbon skeleton having at least one tertiary amino group is represented by the following chemical structure (7):

Chemical structure (7)

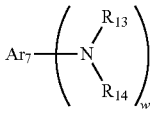

In the Chemical structure (7), $R_{13}$ and $R_{14}$ represent an acyl group, a substituted or non-substituted alkyl group, a substituted or non-substituted aryl group. $Ar_7$ represents an aryl group. W represents an integer of from 1 to 3.

Specific examples of the acyl groups of $R_{13}$ and $R_{14}$ include, but are not limited to, an acetyl group, a propyonyl group, and benzoyl group.

Specific examples of the substituted or non-substituted alkyl group of $R_{13}$ and $R_{14}$ include, but are not limited to, the same alkyl group as the substation group mentioned for $Ar_5$.

Specific examples of the substituted or non-substituted aryl groups of $R_{13}$ and $R_{14}$ include, but are not limited to, phenyl group, naphtyl group, biphenyl group, terphenyl group, pyrenyl group, fluorenyl group, 9,9-dimethyl-2-fluorenyl group, azulenyl group, anthryl group, triphenyl group, chrysenyl group and the group represented by the following Chemical structure (8):

Chemical structure (8)

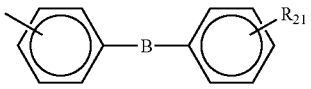

In the Chemical structure (8), B represents —O—, —S—, —SO—, —$SO_2$—, —CO— or the following divalent groups (represented by Chemical structures (9) and (10):

Chemical structure (9)

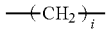

Chemical structure (10)

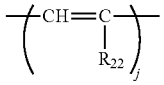

In the Chemical structure (8), $R_{21}$ represents a hydrogen atom, the substituted or non-substituted alkyl groups, alkoxy groups, halogen atoms defined for $Ar_5$, and the substituted or non-substituted aryl groups, amino groups, nitro groups, and cyano groups defined for $R_{13}$. $R_{22}$ represents hydrogen atom, the substituted or non-substituted alkyl groups defined for $Ar_5$, and the substituted or non-substituted aryl groups defined for $R_{13}$. i represents an integer of from 1 to 13 and j represents an integer of from 1 to 3.

Specific examples of the alkoxy groups for $R_{21}$ include, but are not limited to, methoxy group, ethoxy group, n-propoxy group, i-propoxy group, n-butoxy group, i-butoxy group, s-butoxy group, t-butoxy group, 2-hydroxy ethoxy group, 2-cyanoethoxy group, benzyloxy group, 4-methylbenzyloxy group and trifluoro methoxy group.

Specific examples of the halogen atoms for $R_{21}$ include, but are not limited to, fluorine atom, chlorine atom, bromine atom and iodine atom.

Specific examples of the amino groups for $R_{21}$ include, but are not limited to, diphenyl amino group, ditolyl amino group, dibenzyl amino group, and 4-methylbenzyl group.

Specific examples of the aryl groups for $Ar_7$ include, but are not limited to, phenyl group, naphtyl group, biphenyl group, terphenyl group, pyrenyl group, fluorenyl group, 9,9-dimethyl-2-fluorenyl group, azulenyl group, anthryl group, triphenylel group, and chrysenyl group.

$Ar_7$, $R_{13}$ and $R_{14}$ may have the alkyl group, alkoxy group and halogen atom defined for $Ar_5$ as a substitution group.

Specific examples of the heterocyclic skeleton having a tertiary amino group include heterocyclic compounds having an amine structure, for example, pyrrole, pyrazole, imidazole, triazole, dioxazole, indole, isoindole, benzimidazole, benzotriazole, benzoisoxazine, carbazole and pheoxazine. Each of these heterocyclic compounds may contain an alkyl group, an alkoxy group, and a halogen atom defined for the substitutent group of $Ar_5$.

$B_1$ and $B_2$ independently represent an acryloyloxy group, a methacryloyloxy group, vinyl group, an alkyl group having an acryloyloxy group, a methacryloyloxy group or a vinyl group, or an alkoxy group having an acryloyloxy group, a methacryloyloxy group or a vinyl group. The alkyl group and the alkoxy group are those described in the $Ar_5$. $B_1$ and $B_2$ are not present simultaneously.

Specific examples of more preferred structure for the acrylic acid ester compound of the chemical structure (6) include the compounds represented by the following chemical structure (11).

Chemical structure (11)

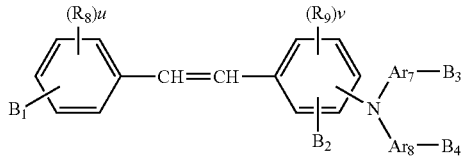

In the chemical structure (11), $R_8$ and $R_9$ respectively represent a substituted or non-substituted alkyl group, a substituted or non-substituted alkoxy group, or a halogen atom; $Ar_7$ and $Ar_8$ independently represent a substituted or non-substituted aryl group or arylene group, or a substituted or non-substituted benzyl group. The alkyl group, the alkoxy group, and the halogen atom include those described for the $Ar_5$.

The aryl group is the same as those defined for the $R_{13}$ and $R_{14}$. The arylene group is a divalent group derived from the aryl group.

$B_1$, $B_2$, $B_3$, and $B_4$ in the chemical structure (6) are the same as those defined for $B_1$, $B_2$, and only one of $B_1$ to $B_4$ exists, i.e., $B_1$, $B_2$, $B_3$ and $B_4$ do not coexist. u is 0 or an integer of from 1 to 5, and v represents 0 or an integer of from 1 to 4.

The specific acrylic ester compound has a tertiary amine compound having a developed stilbene conjugate structure. This developed conjugate system contributes to great improvement in the electric charge infusion property at the interface of a protective layer. Further, when the compound is fixed in cross-linking bond, the intermolecular interaction is hardly inhibited and the electric charge mobility is excellent. The specific acrylic acid ester has one highly radical-polymerized acryloyloxy group or methacryloyloxy group per molecule and is immediately gelatinized during radical polymerization without excessive distortion. Double bonds in the stilbene structural portion in a molecule are partially taken in the polymerization. The polymerizability of the bond is lower than those of an acryloyloxy group or a methacryloyloxy group. Therefore, the time lag occurs in the cross-linking reaction, meaning that the distortion in the compound is not maximized. Furthermore, since double bonds in the molecules are used in cross-linking, the number of cross-linking reactions per molecule increases, resulting in increase in the density of cross-linking. Thus, the abrasion resistance is improved. In addition, the polymerization degree of this double bond can be adjusted depending on the cross-linking conditions, meaning an optimal cross-linking film can be prepared. Such a double bond, which partially forms the radical polymerization, is characteristic to the specific acrylic acid ester compound and does not occur in an α-phenylstilbene structure.

As described above, by using a radical polymerizable monomer having the radical polymerizable functional illustrated in the chemical structure (6), and the chemical structure (11) in particular, it is possible to form a film (layer) having an extremely high cross-linking density without cracking. Therefore, it is possible to provide an image bearing member having excellent characteristics which prevents silica particulates from sticking into the image bearing member, resulting in reduction of image deficiency.

The charge transport compound for use in the present invention having a radical polymerizable functional group represented by the chemical structure (3), (4), (5), (6) or (11), especially (5) or (11), is polymerized in such a manner that the double linkage of C and C is open to both ends. Therefore, the radical polymerizable compound is not present at the end but in the chained polymer. In a polymer in which a cross linking chain is formed with a radical polymerizable monomer having at least 3 functional groups, the radical polymerizable compound is present in the main chains of the polymer and in a cross linking chain. There are two kinds of cross linking chains. One is referred to as inter-molecule cross linking, in which the cross linking chain is formed between a polymer and another polymer. The other is referred to as internal cross linking, in which the cross linking chain is formed between a portion in the main chain present in a polymer formed in a folded state and another portion deriving from the monomer which is polymerized at a position remote from that portion in the main chain. Whether the radical polymerizable monomer having at least 3 functional groups is present in a main chain or in a cross linking chain, the triaryl amine structure suspending from the chain portion has at least three aryl groups disposed in the radial directions from the nitrogen atom therein. Such a triaryl amine structure is bulky and does not directly bind with the chain portion but suspends from the chain portion via a carbonyl group, etc. That is, the triaryl amine structure is stereoscopically fixed in the polymer in a flexible state. Therefore, these triaryl amine structures can be adjacent to each other with a moderate space in a polymer. Therefore, the structural distortion in a molecule is slight. In addition, when the structure is used in the surface layer of an image bearing member, it can be deduced that the internal molecular structure can have a structure in which there are relatively few disconnections in the charge transport route.

Specific examples of the charge transport compounds having a radical polymerizable functional group having a triaryl amine structure as the charge transport structure are illustrated below but are not limited thereto and charge transport compounds having two radical polymerizable functional groups can be also used.

NO. 1

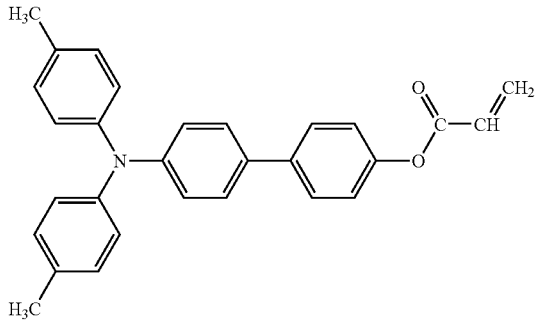

NO. 2

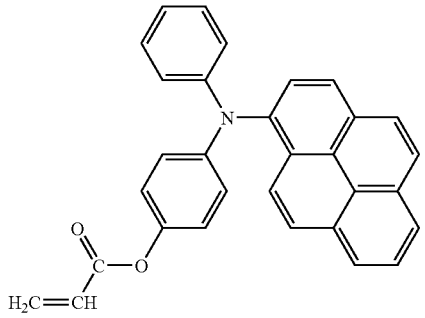

-continued
NO. 3
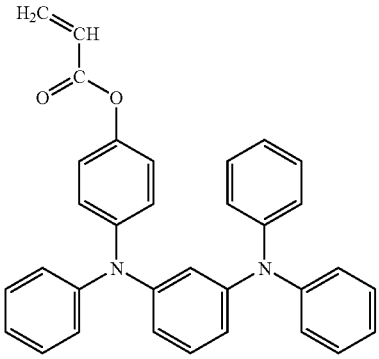
NO. 4
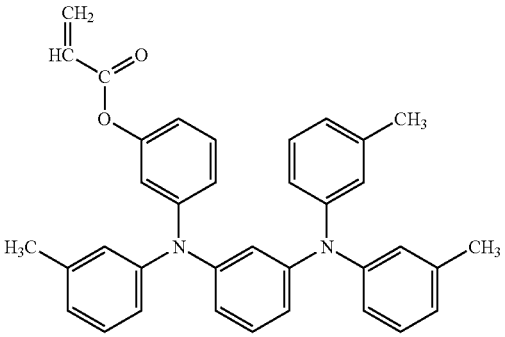
NO. 5
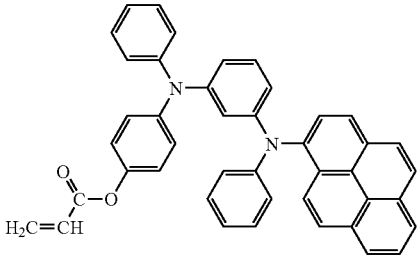
NO. 6
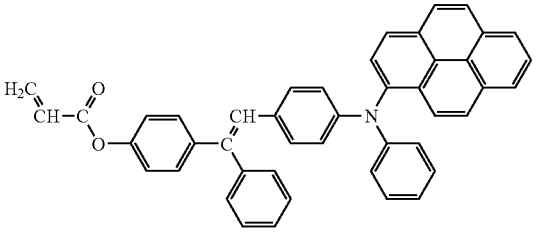
NO. 7
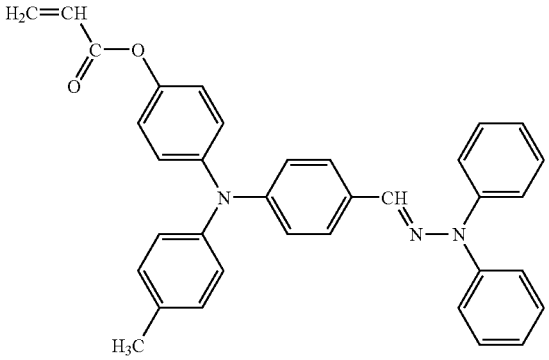
NO. 8
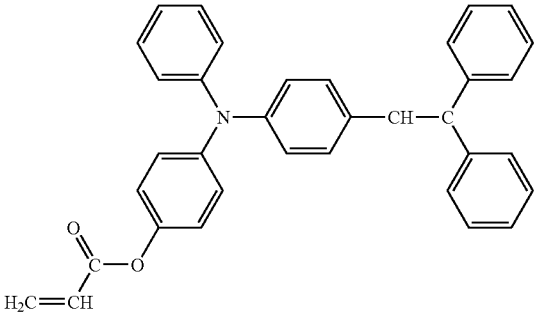
NO. 9
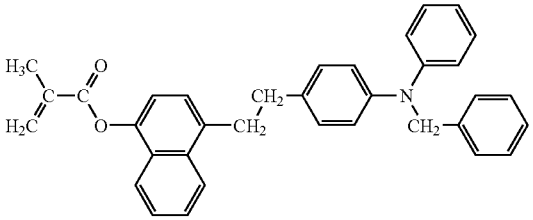
NO. 10
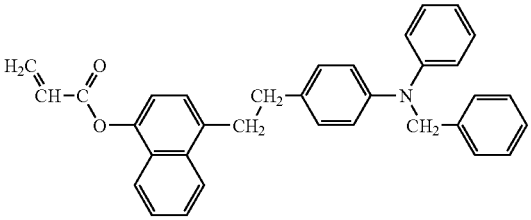
NO. 11
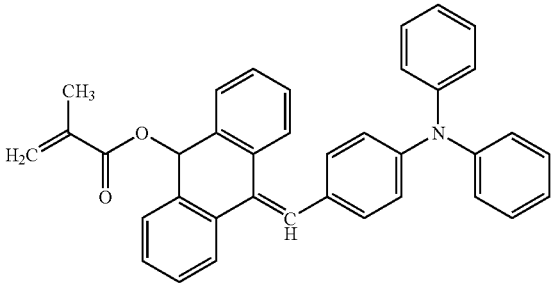
NO. 12
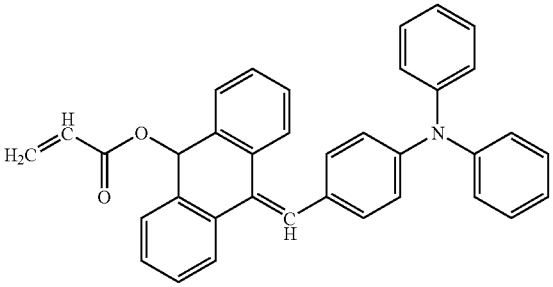

-continued
NO. 13
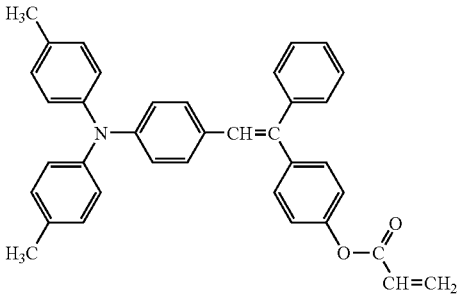
NO. 14
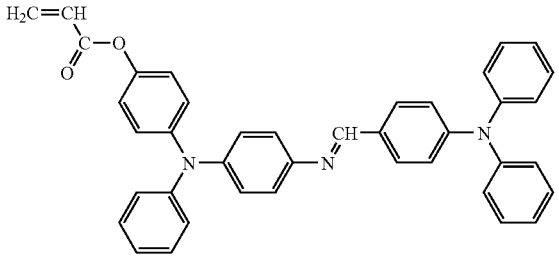
NO. 15
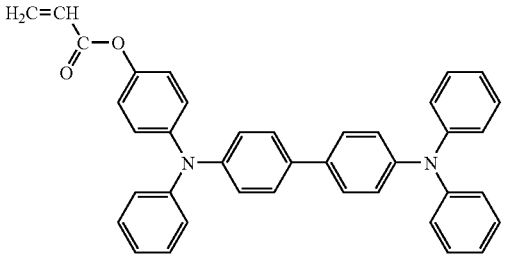
NO. 16
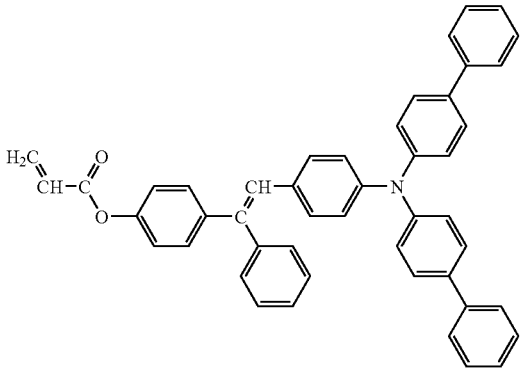
NO. 17
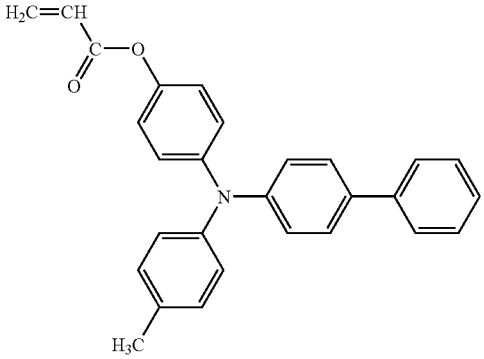
NO. 18
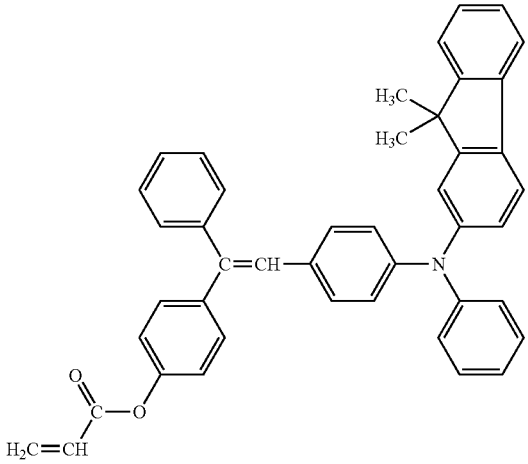
NO. 19
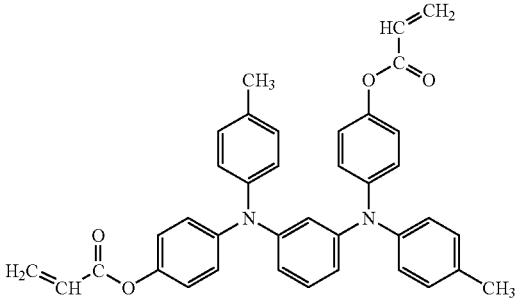
NO. 20
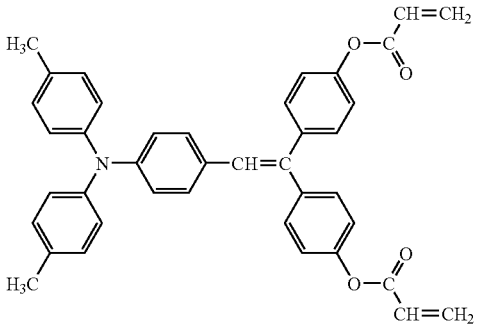

-continued
NO. 21
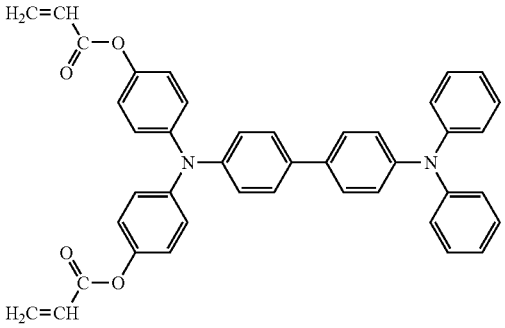
NO. 22
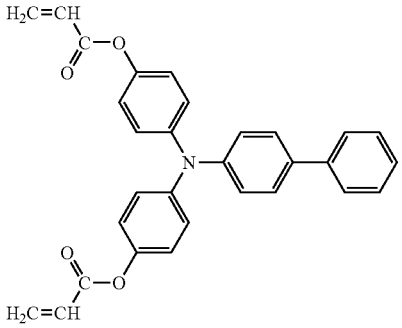
NO. 23
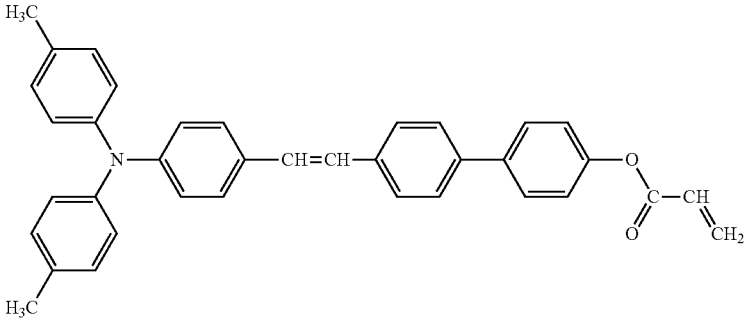
NO. 24
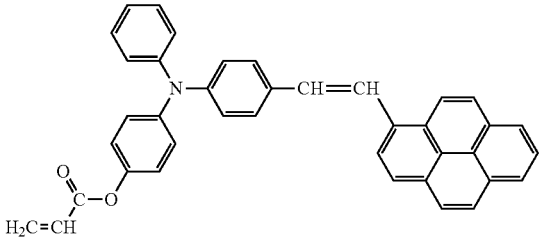
NO. 25
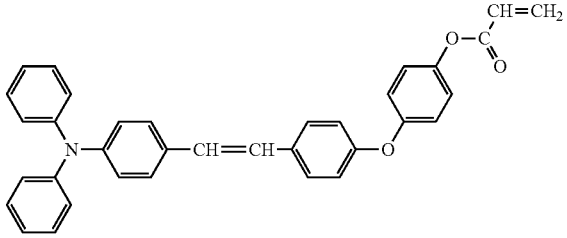
NO. 26
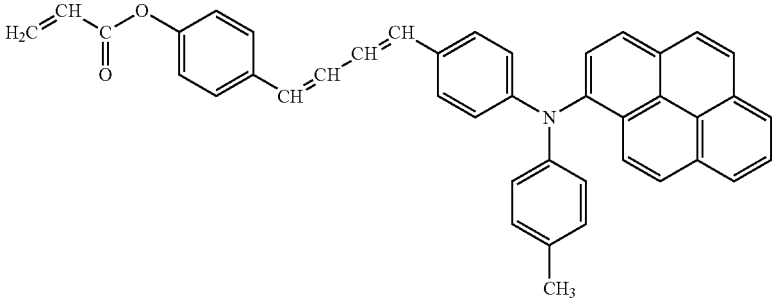
NO. 27
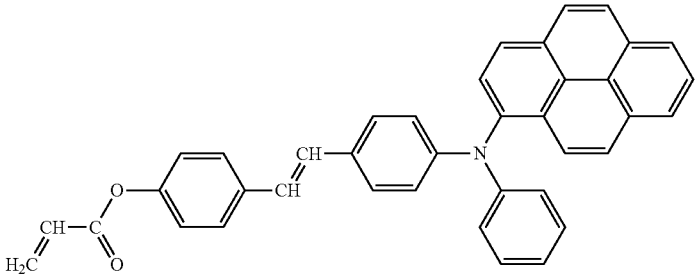

-continued
NO. 28
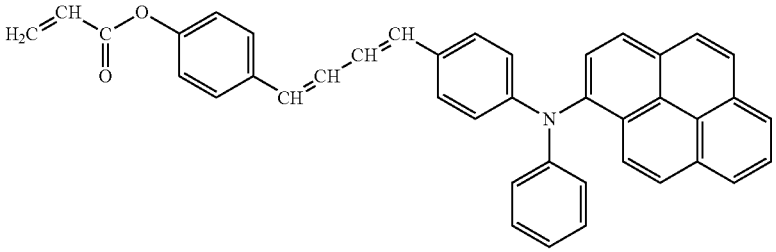
NO. 29
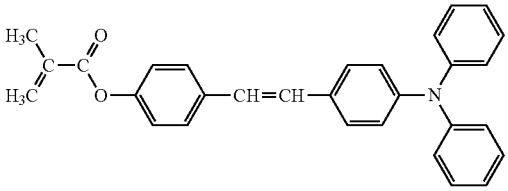
NO. 30
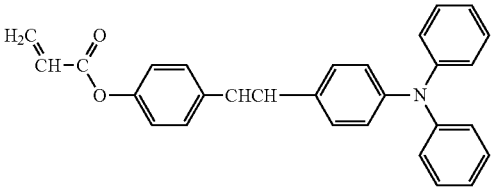
NO. 31
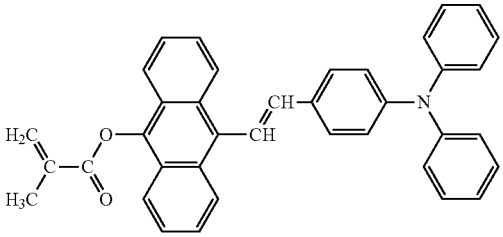
NO. 32
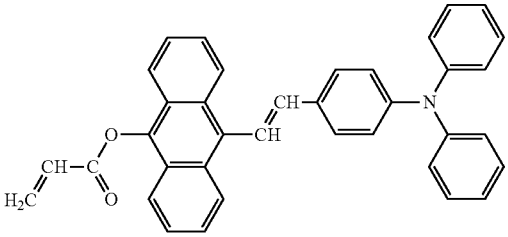
NO. 33
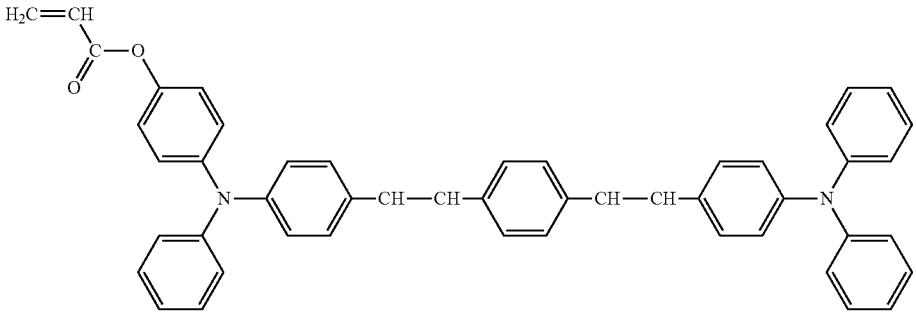
NO. 34
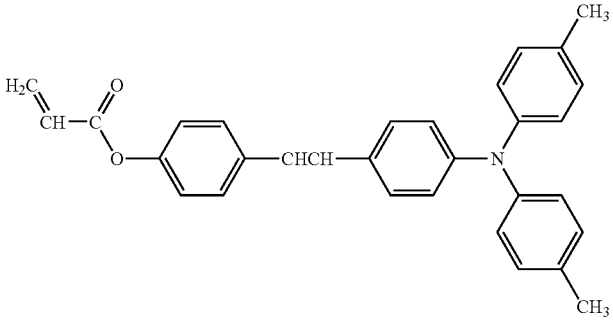

-continued
NO. 35
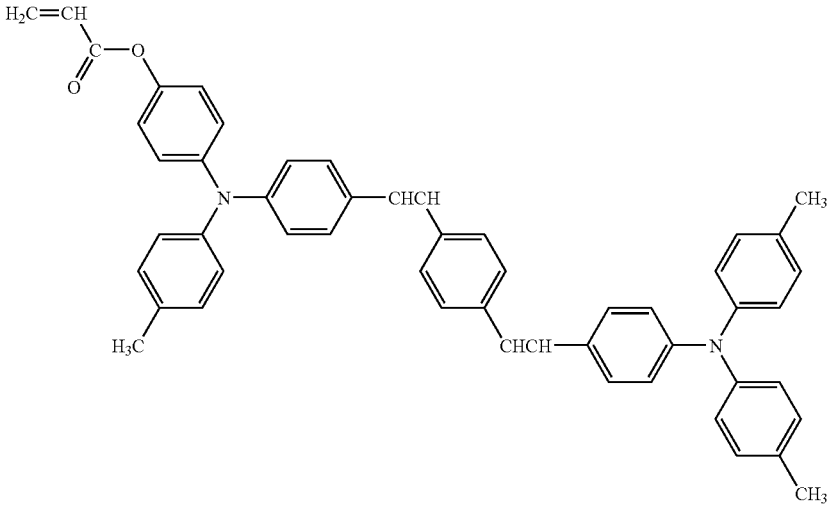
NO. 36
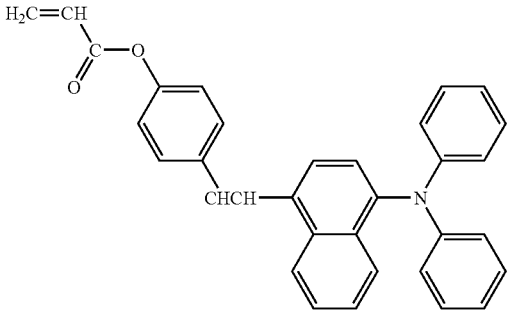
NO. 37
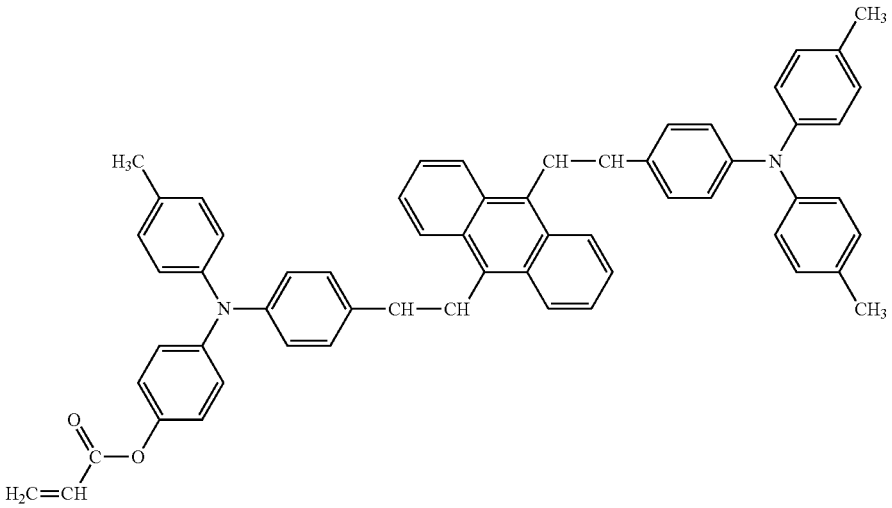

-continued
NO. 38
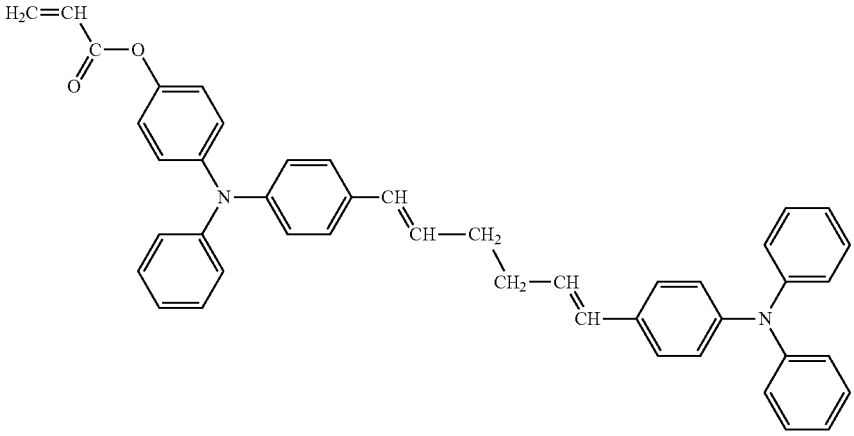
NO. 39
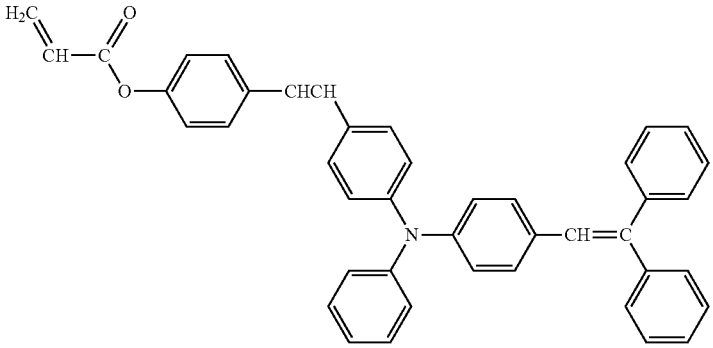
NO. 40
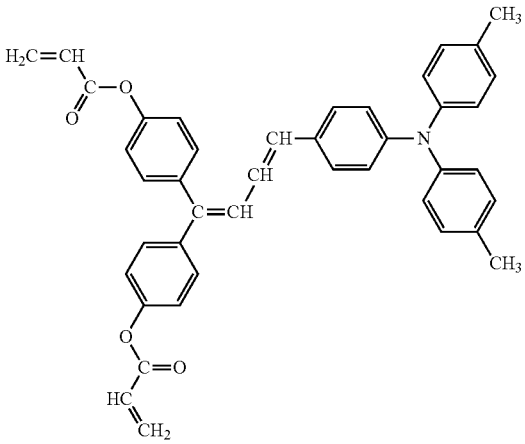

-continued
NO. 41
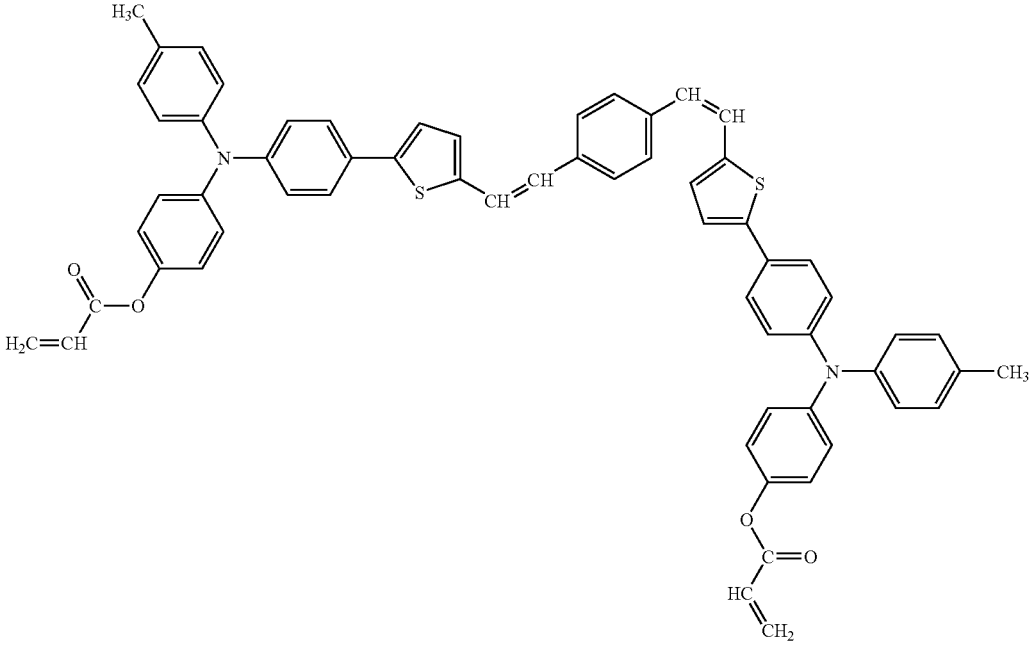
NO. 42
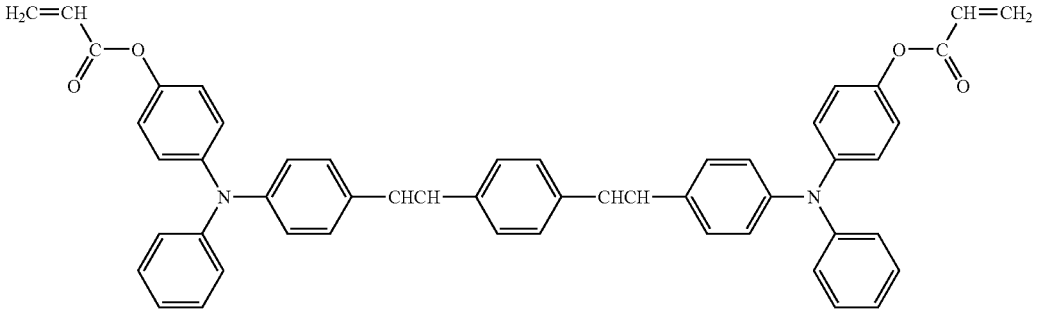
NO. 43
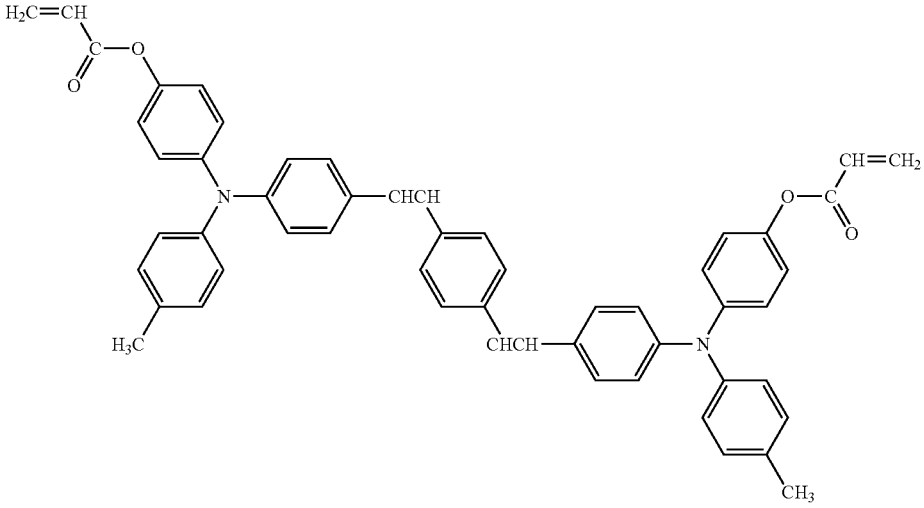

-continued

NO. 44

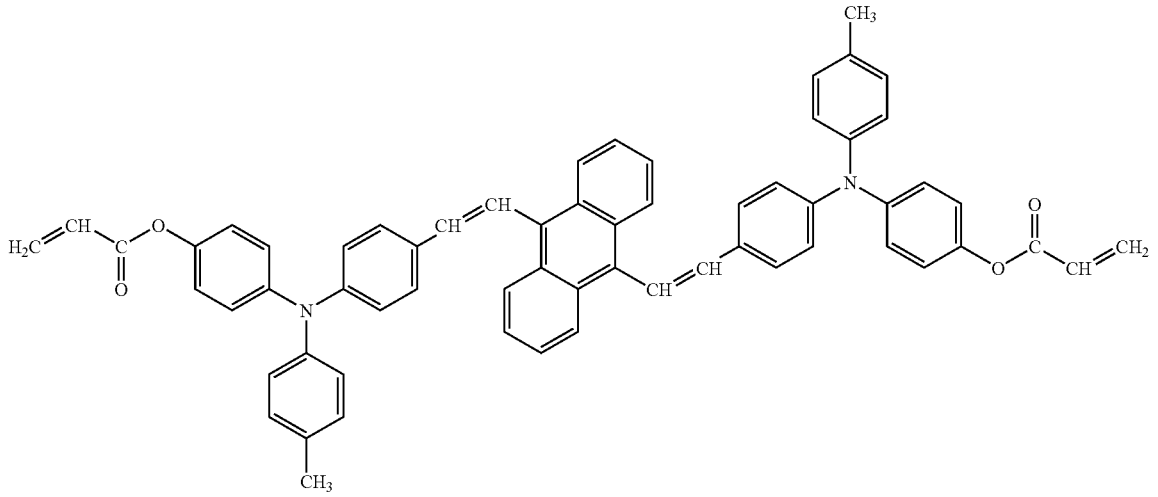

NO. 45

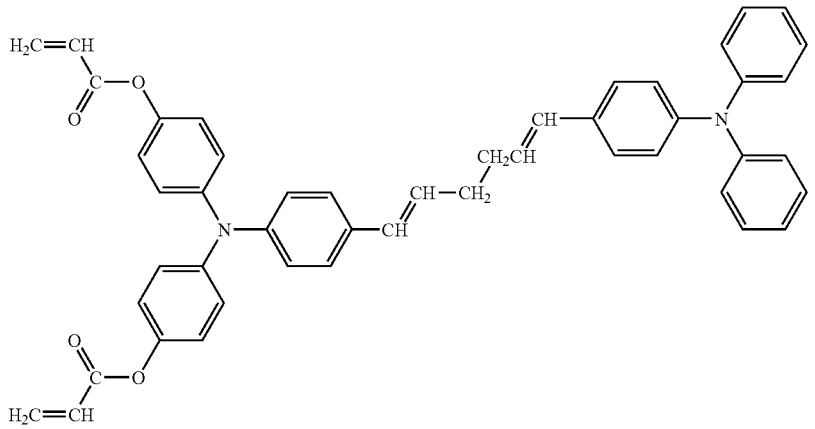

NO. 46

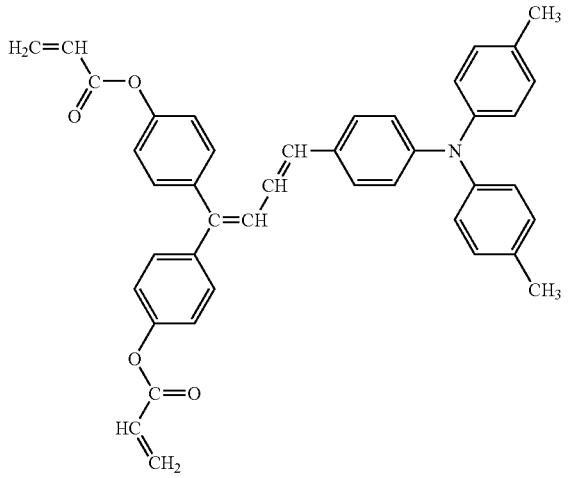

The charge transport compound having a radical polymerizable functional group for use in the present invention imparts a charge transport function to a protective layer. The content of the charge transport compound is from 20 to 80% by weight, and preferably from 30 to 70% by weight, based on the total weight of a protective layer. When the content is too small, the charge transport function of the protective layer is not maintained, which may lead to the deterioration of the electric characteristics, for example, sensitivity degradation and residual voltage rise, over repetitive use. When the content is too large, the content of the radical polymerizable monomer having at least three functional groups without a charge transport structure decreases. That is, the cross linking density decreases so that the anti-abrasion property is not sufficient. Desired electric characteristics and anti-abrasion property vary depending on the process, it is difficult to jump to any conclusion but considering the balance of both characteristics and property, the addition amount is most preferable from 30 to 70% by weight.

Radical Polymerizable Monomer Having No Charge Transport Structure

As the radical polymerizable compounds for use in the present invention, a radical polymerizable monomer having no charge transport structure can be suitably used. Specific examples of the radical polymerizable monomer having no charge transport structure include, but are not limited to, a compound having the radical polymerizable functional group described for the radical polymerizable compound having a charge transport structure. As the radical polymerizable functional group, acryloyloxy group or methacryloyloxy group is especially preferred. In addition, in teams of improvement on anti-abrasion property, a radical polymerizable monomer having three or more radical polymerizable functional groups of acryloyloxy groups or methacryloyloxy group is effectively used.

A compound having three or more acryloyloxy groups can be obtained by conducting, for example, an ester reaction or an ester exchange reaction of a compound having 3 or more hydroxyl groups in the molecule thereof, an acrylic acid (salt), an acrylic acid halide, and an acrylic acid ester. A compound having 3 or more methacryloyl groups can also be obtained in the same manner. The radical polymerizable functional groups in the monomer having 3 or more radical polymerizable functional groups may be the same or different from each other.

Specific examples of the monomer having at least three radical polymerizable functional groups without a charge transport structure include the following compounds but are not limited thereto.

That is, specific examples of the monomer described above for use in the present invention include, but are not limited to, trimethylolpropane triacrylate (TMPTA), trimethylolpropane trimethacrylate, trimethylolpropane alkylene-modified (HPA-modified)triacrylate, trimethylol propane ethylene oxy-modified (EO-modified)triacrylate, trimethylolpropane propyleneoxy-modified (PO-modified)triacrylate, trimethylolpropane caprolactone-modified triacrylate, trimethylolpropane alkylene-modified trimethacrylate, pentaerythritol triacrylate, pentaerythritol tetraacrylate (PETTA), glycerol triacrylate, glycerol epichlorohydrine-modified (ECH-modified)triacrylate, glycerol EO-modified triacrylate, glycerol PO-modified triacrylate, tris(acryloxyethyl) isocyanurate, dipentaerythritol hexaacrylate (DPHA), dipentaerythritol caprolactone-modified hexaacrylate, dipentaerythritol hydroxypentaacrylate, alkyl-modified dipentaerythritol pentaacrylate, alkylated dipentaerythritol tetraacrylate, alkyl-modified dipentaerythritol triacrylate, dimethylolpropane tetraacrylate (DTMPTA), pentaerythritol ethoxytetraacrylate, phosphoric acid EO-modified triacrylate, and 2,2,5,5-tetrahydroxymethyl cyclopentanone tetraacrylate. These can be used alone or in combination.

With regard to the monomer having at least three radical polymerizable functional groups without a charge transport structure for use in the present invention, the ratio of molecular weight relative to the number of functional groups (molecular weight/the number of functional group) in the monomer is preferably from 250 or less to form a dense cross-linking bond in the protective layer. When the ratio is excessively great, the protective layer is soft, and the abrasion resistance is degraded in some degree. Thus, it is not suitable to single out a compound having an extremely long modified group for use among the monomers having a modified group, for example, HPA-modified, EO-modified, and PO-modified group. The content of the monomer having at least three radical polymerizable functional groups without a charge transport structure for use in the protective layer is from 20 to 80% by weight, and preferably from 30 to 70% by weight based on the total amount of the protective layer. When the content of the monomer component is too small, the three dimensionally cross-linked bonding density of the protective layer tends to be low. Also the abrasion resistance is not significantly improved in comparison with the case where a typical thermoplastic binder resin is used. When the content of the monomer is too great, the content of the charge transport compound tends to decrease, which causes degradation of electric properties. It is difficult to jump to any conclusion since the demand for the abrasion resistance and the electric characteristics varies depending on the process but considering a good combination of the abrasion resistance and the electric characteristics, the content of the monomer preferably ranges from 30 to 70% by weight.

A radical polymerizable monomer having one or two functional groups, functional monomers, and a radical polymeric oligomer can be used to provide functions, for example, adjusting the viscosity upon coating, relaxing the stress in the protective layer, decreasing the surface energy, and reducing the friction index, etc. Any known radical polymerizable monomers and oligomers can be used.

Specific examples of the radical polymerizable monomer having one functional group include, but are not limited to, monomers of 2-ethylhexyl acrylate, 2-hydroxyethyl acrylate, 2-hydroxypropyl acrylate, tetrahydrofurfuryl acrylate, 2-ethylhexyl carbitol acrylate, 3-methoxybutyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearyl acrylate, stearyl acrylate, and styrene.

Specific examples of the radical polymerizable monomer having two functional groups include, but are not limited to, 1,3-butandiol diacrylate, 1,4-butane diol diacrylate, 1,4-butane diol dimethacrylate, 1,6-hexane diol diacrylate, 1,6-hexane diol dimethacrylate, diethylene glycol diacrylate, neopenthyl glycol diacrylate, bisphenol A-EO modified diacrylate, bisphenol F-EO modified diacrylate and neopenthyl glycol diacrylate.

Specific examples of the functional monomer include, but are not limited to, monomers in which a fluorine atom of, for example, octafluoro penthyl acrylate, 2-perfluorooctyl ethyl acrylate, 2-perfluorooctyl ethyl methacrylate and 2-perfluoroisononyl ethyl acrylate is substituted, and vinyl monomers, acrylates and methacrylates having polysiloxane groups, for example, acryloyl polydimethyl siloxane ethyl, methacryloyl polydimethyl siloxane ethyl, acryloyl polydimethyl siloxane propyl, acryloyl polydimethyl siloxane butyl and diacryloyl polydimethyl siloxane diethyl having 20 to 70 siloxane repeating units set forth in examined published Japanese patent applications Nos. (hereinafter referred to as JPP) H05-60503 and H06-45770.

Specific examples of the radical polymeric oligomer include epoxyacrylate based, urethane acrylate based, and polyester acrylate based oligomers.

When a radical polymerizable monomer and/or a radical polymeric oligomer having one or two functional groups are contained in a large amount, the three dimensional cross linking density of the cross linking type protective layer 41 substantially decreases, which invites the deterioration of the anti-abrasion property. Therefore, the content of these monomers and oligomers is not greater than 50 parts by weight and preferably not greater than 30 parts by weight based on 100 parts by weight of the radical polymerizable monomer having at least three functional groups.

Polymerization Initiator

It is possible to use a polymerization initiator in the cross-linking surface layer (protective layer) to effectively conduct the curing reaction, if desired.

Specific examples of thermal polymerization initiator include peroxide-based initiators, for example, 2,5-dimethylhexane-2,5-dihydroperoxide, dicumyl peroxide, benzoyl peroxide, t-butyl cumyl peroxide, 2,5-dimethyl-2,5-di(peroxybenzoyl) hexyne-3, di-t-butyl peroxide, t-butylhydroperoxide, cumene hydroperoxide, and lauroyl peroxide, and azo based initiators, for example, azobis isobutylnitrile, azobiscyclohexane carbonitrile, azobis methyl isobutyric acid, azobis isobutyl amidine hydrochloride salts, and 4,4'-azobis-4-cyano valeric acid.

Specific examples of photo polymerization initiators include acetophenone based or ketal based photo polymerization initiators, for example, diethoxy acetopenone, 2,2-dimethoxy-1,2-diphenylethane-1-one, 1-hydroxy cyclohexyl phenylketone, 4-(2-hydroxyethoxy)phenyl-(2-hydroxy-2-propyl)ketone, 2-benzyl-2-dimethylamino-1-(4-morpholinophenyl)butanone-1,2-hydroxy-2-methyl-1-phenylpropane-1-one, 2-methyl-2-morpholino(4-methylthiophenyl)propane-1-one, and 1-phenyl-1,2-propane dione-2-(o-ethoxycarbonyl)oxime;

benzoin ether based photo polymerization initiators, for example, benzoine, benzoine methyl ether, benzoin ethyl ether, benzoine isobutyl ether and benzoine isopropyl ether; benzophenone based photo polymerization initiators, for example, benzophenone, 4-hydroxy benzophenone, o-benzoyl benzoic acid methyl, 2-benzoyl naphthalene, 4-benzoyl biphenyl, 4-benzoyl phenyl ether, acrylated benzophenone and 1,4-benzoyl benzene; and thioxanthone based photo polymerization initiators, for example, 2-isopropyl thioxanthone, 2-chloro thioxanthone, 2,4-dimethyl thioxanthone, 2,4-diethyl thioxanthone, and 2,4-dichloro thioxanthone.

Other photo polymerization initiators are, for example, ethyl anthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxy benzoyl)-2,4,4-trimethyl pentyl phosphine oxide, methylphenyl glyoxy esters, 9,10-phenanthrene, acridine based compounds, triadine based compounds, and imidazole based compounds.

In addition, compounds having photo polymerization promotion effect can be used alone or in combination with the photo polymerization initiators mentioned above. Specific examples thereof include, but are not limited to, triethanol amine, methyldiethanol amine, 4-dimethylamino ethyl benzoate, 4-dimethylamino isoamile benzoate, benzoic acid (2-dimethylamino)ethyl, and 4,4'-dimethylamino benzophenone.

These polymerization initiators can be used alone or in combination. The addition amount of the polymerization initiator is from 0.5 to 40 parts by weight and preferably from 1 to 20 parts by weight based on 100 parts by weight of the total weight of the radical polymerizable compound.

Additive

Furthermore, a liquid application for use in the present invention can contain additives, for example, various kinds of a plasticizing agent (to relax internal stress or improve adhesiveness), a leveling agent, and a low molecular weight charge transport material which is not radically reactive, if desired. Any known additives can be used. Specific examples of the plasticizing agent include, but are not limited to, dibutyl phthalate and dioctyl phthalate, which are typically used for resins. The addition amount of the plasticizing agent is not greater than 20% by weight and more preferably not greater than 10% by weight based on all the solid portion of the liquid application. Specific examples of the leveling agent include, but are not limited to, silicone oils such as dimethyl silicone oil and methylphenyl silicone oil, and polymers or oligomers having a perfluoroalkyl group in its branch chain. The addition amount of the leveling agent is not greater than 3% by weight based on all the solid portion of the liquid application.

Dilution Solvent for Liquid Application for Protective Layer

With regard to the dilution solvent for a liquid application for the protective layer, when a solvent having a slow evaporation speed is used, the remaining solvent may inhibit the curing reaction or increase the content of contaminants from the layer provided under the protective layer, which causes non-uniform curing and the decrease in the curing density. Therefore, the protective layer tends to be soluble in an organic solvent. Suitable specific examples of the dilution solvents include tetrahydrofuran, a mixture solvent of tetrahydrofuran and methanol, ethyl acetate, methylethyl ketone and ethylcellosolve. These are selected in combination with a coating method. When the density of solid portion in a liquid application is too low, the protective layer formed thereof tends to be dissolved in an organic solvent due to the same reason as described above.

To the contrary, on account of the restraint on the layer thickness and the viscosity of a liquid application, the density has an upper limit. Specifically, the density is preferred to be from 10 to 50% by weight. As a method of coating a liquid application to a protective layer, as described above, a method is preferred in which the content of the solvent during coating is small and the contact time of the solvent is short. To be specific, a spray coating method or a ring coating method in which the amount of a liquid application is regulated is preferred. In addition, to restrain the amount of the components infused from the layer provided under the protective layer, it is effective to use a charge transport polymer for the charge transport layer and/or provide an intermediate layer insoluble in a liquid application for the protective layer.

Especially in the case of a solvent slow in evaporation, a large amount of the charge transport material in the charge transport layer infuses into the entire portion of the protective layer. In this case, the protective layer does not have a sufficient mechanical strength. This can be confirmed by the result of a 3,000 sheet running test in which the ratio of the amount of abrasion of the surface of the protective layer to the amount of abrasion of the protective layer at a depth of 2 μm from the surface of the charge transport layer is from 0.8 to 1.3 and the amount of abrasion of the charge transport layer is 3 to 10 times as much as the amount of abrasion of the protective layer. To confirm this, the 3,000 sheet running test is not necessary when the amount of abrasion of the protective layer can be measured by an eddy-current thickness measuring device (manufactured by Fisher Instrument Company).

Method of Forming Protective Layer

As the application method of the protective layer for use in the present invention, there are a dip coating method, a spray coating method, a bead coating method, a ring coating method, etc. Among these, a spray coating method is suitably used because the amount of residual solvent in the applied layer upon application can be suitably controlled by the spray coating method.

In the present invention, subsequent to the application of a liquid application of the protective layer, the protective layer is cured by application of external energy, for example, light and radiation ray. As light energy, a UV irradiation light source, for example, a high pressure mercury lamp or a metal halide lamp having an emission wavelength mainly in the ultraviolet area can be used. A visible light source can be selected according to the absorption wavelength of a radical polymeric compound and a photopolymerization initiator. The irradiation light amount is preferably from 50 mW/cm$^2$ to 1,000 mW/cm$^2$. When the irradiation light amount is too small, it easily takes a long time to complete the curing reaction. When the irradiation light amount is too large, the reaction tends to be not uniformly conducted, resulting in the occurrence of wrinkle on the surface of the protective layer and a significant amount of non-reacted groups and polymerization terminated ends. In addition, the internal stress in the protective layer increases due to such rapid cross-linking, which causes cracking and peeling thereof. As radiation ray energy, electron beam can be used. Among these forms of energies, light energy is suitably used in terms of easiness of reaction speed control and simplicity of a device.

The layer thickness of the protective layer in the present invention is from 3 to 15 μm, preferably from 4 to 15 μm and more preferably from 4 to 10 μm. When the layer thickness is too thick, cracking and peeling off easily occur as described above. When the layer thickness is in the more preferred range, the safety margin is improved so that the density of cross-linking can be increased. Furthermore, it is possible to select a material and set a curing condition to improve the anti-abrasion property. On the other hand, the radical polymerization reaction is vulnerable to oxygen inhibition. That is, on the surface, which contacts air, cross-linking tends to not proceed at all or uniformly due to the radical trap caused by oxygen. This radical trap has a significant effect on the portion having a depth not greater than 1 μm from the surface. Therefore, in the protective layer having a thickness not greater than 1 μm, the anti-abrasion property may deteriorate and non-uniform abrasion may occur. In addition, when the protective layer is applied, the components of the charge transport layer provided below the protective layer may mingle into the protective layer. When the layer thickness of the protective layer is too thin, contaminant may diffuse into the entire protective layer, which leads to the inhibition of the curing reaction and a decrease in the density of cross-linking. Considering these, the protective layer having a layer thickness not less than 4 μm has a good anti-abrasion property and anti-damage property. But when the protective layer is locally ground to the charge transport layer provided under the protective layer during repetitive use, the ground portion is further abraded, resulting in the production of a half tone image with uneven density due to the fluctuation of chargeability and sensitivity. Therefore, to obtain a durable image bearing member and improve the image quality, the layer thickness of the protective layer is preferably at least 4 μm.

When a large amount of a binder resin having no radical polymerizable functional group and an additive such as an anti-oxidizing agent and a plasticizer are contained in the composition of the liquid application for the cross linking surface layer in addition to the radical polymerizable compound described above, the density of the cross linking decreases and the phase separation occurs between the cured material obtained as the result of the reaction and the additives. Consequently, the composition may become soluble in an organic solvent. Specifically, it is desired to restrain the content of the additives within not greater than 20% by weight based on the total solid portion of the liquid application.

With regard to the curing conditions of the protective layer, when the light irradiation energy is too low, the curing reaction is not completely conducted. Therefore, the solubility thereof in an organic solvent increases. By contrast, extremely high energy causes non-uniform curing reaction, which leads to an increase of non-cross linked portions and radical terminated portions and formation of an agglomeration of minute cured materials. Thus, the protective layer tends to be dissolved in an organic solvent. To make the protective layer insoluble in an organic solvent, UV irradiation curing is preferably performed at a range of from 50 to 1,000 mW/cm$^2$ for 5 seconds to 5 minutes while restraining the temperature within 50° C. Thereby, non-uniform curing reaction can be prevented.

Layer Structure of Image Bearing Member

The image bearing member of the present invention is described with reference to drawings.

FIG. 1 is a cross section illustrating the image bearing member of the present invention.

The image bearing member in FIG. 1 has a laminate structure in which a photosensitive layer formed of a charge generating layer having a charge generation function and a charge transport layer having a charge transport function is provided on an electroconductive substrate. A protective layer occupies the surface portion of the charge transport layer.

Electroconductive Substrate

Materials having a volume resistance of not greater than $10^{10}$ Ω·cm can be used as a material for the electroconductive substrate. For example, there can be used plastic or paper having a film form or cylindrical form covered with a metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Further, a tube which is manufactured from the board mentioned above by a crafting technique such as extruding and extracting and surface-treatment such as cutting, super finishing and grinding is also usable. In addition, endless nickel belt and endless stainless belt (for example, described in JOP S52-36016) can be used as the electroconductive substrate.

The electroconductive substrate of the present invention can be formed by applying to the substrate mentioned above a liquid application in which electroconductive powder is dispersed in a suitable binder resin.

Specific examples of such electrconductive powder include carbon black, acetylene black, metal powder such as aluminum, nickel, iron, nichrome, copper, zinc and silver, and metal oxide powder such as electroconductive tin oxide, and ITO.

Specific examples of the binder resins which are used together with the electroconductive powder include thermoplastic resins, thermosetting resins, and optical curing resins such as a polystyrene, a styrene-acrylonitrile copolymer, a styrene-butadiene copolymer, a styrene-anhydride maleic acid copolymer, a polyester, a polyvinyl chloride, a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acryl resin, a silicone resin, an epoxy resin, a melamine resin, an urethane resin, a phenol resin, and an alkyd resin. Such an electroconductive layer can be formed by dispersing the electroconductive powder and the binder resins mentioned above in a suitable solvent such as tetrahydrofuran (THF), dichloromethane (MDC), methyl ethyl ketone (MEK), and toluene and applying the resultant to a substrate.

Also, an electroconductive substrate foamed by providing a heat contraction rubber tube on a suitable cylindrical substrate can be used as the electroconductive substrate of the present invention. The heat contraction tube is formed of a material such as polyvinyl chloride, polypropylene, polyester, polystyrene, polyvinylidene chloride, polyethylene, chloride rubber, and TEFLON® in which the electroconductive powder mentioned above is contained.

Photosensitive Layer

Next, the photosensitive layer is described. The photosensitive layer can be a laminate structured or a single layered.

The photosensitive layer is formed of a charge generating layer having a charge generating function and a charge transport layer having a charge transport function.

(1) Charge Generating Layer

The charge generating layer is a layer mainly formed of a charge generating material having a charge generating function with an optional binder resin. As the charge generating material, an inorganic material and an organic material can be used.

Specific examples of the inorganic material include crystal selenium, amorphous selenium, selenium-tellurium, selenium-tellulium-halogen, selenium-arsenic compounds and amorphous silicon. With regard to the amorphous silicon, amorphous silicon in which the dangling bonding is terminated by hydrogen atoms and halogen atoms or boron atoms and phosphorous atoms are doped are suitably used.

On the other hand, known materials can be used as the organic materials. Specific examples thereof include phthalocyanine based pigments, for example, metal phthalocyanine and non-metal phthalocyanine, azulenium salt pigments, methine squaric acid pigments, azo pigments having carbazolee skeleton, azo pigments having triphenyl amine skeleton, azo pigments having dibenzothiophene skeleton, azo pigments having fluorenone skeleton, azo pigments having oxadiazole skeleton, azo pigments having bis stilbene skeleton, azo pigments having distyryl oxadiazole skeleton, azo pigments having distyryl carbazolee skeleton, perylene based pigments, anthraquinone based or polycyclic quinone pigments, quinone imine pigments, diphenyl methane based pigments, triphenyl methane based pigments, benzoquinone based pigments, naphthoquinone based pigments, cyanine based pigments, azomethine based pigments, indigoid based pigments, and bisbenzimidazole pigments. These charge generating materials can be used alone or in combination.

Specific examples of the optional binder resins for use in a charge generating layer include polyamides, polyurethanes, epoxy resins, polyketones, polycarbonates, silicone resins, acrylic resins, polyvinyl butyrals, polyvinyl formals, polyvinyl ketones, polystyrenes, polysulfones, poly-N-vinyl carbazoles, and polyacrylamides. These binder resins can be used alone or in combination. In addition to the binder resins mentioned as the binder resin for the charge generating layer, charge transport polymer materials having a charge transport function, for example, polymer materials, for example, polycarbonate resins, polyester resins, polyurethane resins, polyether resins, polysiloxane resins, and acryl resins which have arylamine skeleton, benzidine skeleton, hydrazone skeleton, carbazole skeleton, stilbene skeleton, pyrazoline skeleton, etc.; and polymer materials having polysilane skeleton, can be used as the binder resin.

Specific examples of the binder resin include, but are not limited to, charge transport materials set forth in, for example, JOPs H01-001728 (S64-1728), H01-009964, H01-013061, H01-019049, H01-241559, H04-011627, H04-175337, H04-183719, H04-225014, 1-104-230767, H04-320420, H05-232727, H05-310904, H06-234836, H06-234837, H06-234838, H06-234839, H06-234840, H06-234841, H06-239049, H06-236050, H06-236051, H06-295077, H07-056374, H08-176293, H08-208820, H08-211640, H08-253568, H08-269183, H09-062019, H09-043883, H09-71642, H09-87376, H09-104746, H09-110974, H09-110976, H09-157378, H09-221544, H09-227669, H09-268226, H09-272735, H09-302084, H09-302085 and H09-328539.

Specific examples of the charge transport polymer materials having a charge transport function include, but are not limited to, polysililenes set forth in JOP S63-285552, H05-19497, H05-70595 and H10-73944.

In addition, the charge generating layer can contain a charge transport material having a low molecular weight.

As the charge transport material having a low molecular weight for use in the generating layer, there are two types thereof, which are a positive hole transport material and an electron transport material.

Specific examples of the charge transport materials include, but are not limited to, electron accepting materials, for example, chloroanyl, bromoanyl, tetracyanoethylene, tetracyano quinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitro dibenzothiophen-5,5-dioxide, and diphenoquinone derivatives. These can be used alone or in combination.

As the positive hole transport materials, the following electron donating materials can be suitably used.

Specific examples of the positive hole transport materials include, but are not limited to, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, enamine derivatives and other known materials. These charge transport materials can be used alone or in combination.

As a method of forming a charge generating layer, it is possible to use a vacuum thin layer manufacturing method and a casting method from a solution dispersion system.

Specific examples of the vacuum thin layer manufacturing method include a vacuum deposition method, a glow discharging decomposition method, an ion plating method, a sputtering method, and a reactive sputtering method and a chemical vacuum deposition (CVD) method. Both inorganic materials and organic materials mentioned above can be used to form a charge transport layer.

When a casting method is used, if desired, it is possible to form a charge generating layer by applying a suitably diluted liquid dispersion obtained by dispersing an inorganic material or an organic material in a solvent together with a binder resin using a dispersing device. Specific examples of the solvent include tetrahydrofuran, dioxane, dioxolan, toluene, dichloromethane, monochlorobenzene, dichloroethane, cyclohexanone, cyclopentanone, anisole, xylene, methylethylketone, acetone, ethyl acetate and butyl acetate. Specific examples of the dispersing device include a ball mill, an attritor, a sand mill, and a bead mill. In addition, if desired, a leveling agent, for example, dimethyl silicone oil and methylphenyl silicone oil, can be added to the liquid dispersion mentioned above. Furthermore, the application mentioned above is performed by a dip coating method, a spray coating method, a bead coating method and a ring coating method.

In the present invention, the thickness of the charge transport layer is preferably from 0.01 to 5 μm and more preferably from 0.05 to 2 μm.

(2) Charge Transport Layer

The charge transport layer can be formed by dispersing or dissolving a charge transport material having a charge transport function and a binder resin in a suitable resin, and applying the resultant to a charge generating layer followed by drying.

As the charge transport material, the charge transport materials, positive hole transport materials and charge transport polymer materials can be used. Especially, using the charge transport polymer materials is effective to reduce the solubility of the layer underlying a surface layer during application thereof.

Specific examples of the binder resins include, but are not limited to, thermal curing resins and thermal plastic resins such as polystyrenes, styrene-acrylonitrile copolymers, styrene-butadiene copolymers, styrene-maleic acid anhydride copolymers, polyesters, polyvinyl chlorides, vinyl chloride-vinyl acetate copolymers, polyvinyl acetates, polyvinyl vinylidenes, polyarates, phenoxy resins, polycarbonates, cellulose acetate resins, ethyl cellulose resins, polyvinyl butyrals, polyvinyl formals, polyvinyl toluene, poly-N-vinylcarbazols, acrylic resins, silicone resins, epoxy resins, melamine resins, urethane resins, phenol resins, and alkyd resins.

The content of such a charge transport material is from 20 to 300 parts by weight and preferably from 40 to 150 parts by weight based on 100 parts by weight of a binder resin. When a charge transport polymer is used, the charge transport polymer can be used alone or in combination with a binder resin.

As the solvent for use in application of a charge transport layer, the same solvent as those mentioned for the charge transport layer can be used and among these the solvent that suitably dissolves the charge transport material and the binder resin is preferred. These solvents can be used alone or in combination. To form the charge transport layer, the same method as those for the charge generating layer can be used.

The charge transport layer for use in the present invention can include additives such as a plasticizer and a leveling agent. Specific examples of the plasticizers include known plasticizers such as dibutyl phthalate and dioctyl phthalate for a binder resin. The content of the plasticizer in the charge transport layer is from 0 to about 30 parts by weight based on 100 parts of the binder resin.

As the leveling agent for use in the charge transport layer, silicone oil such as dimethyl silicone oil, methyl phenyl silicone oil and a polymer or an oligomer having a perfluoroalkyl group in its side chain can be used. The content thereof is suitably from 0 to about 1 part by weight based on 100 parts of the binder resin.

The layer thickness of the charge transport layer is suitably from about 5 to about 40 μm and preferably from about 10 to about 30 μm.

Undercoating Layer

As to the image bearing member of the present invention, an undercoating layer can be provided between the electroconductive substrate and the photosensitive layer. In general, such an undercoating layer is mainly formed of a resin. Considering the case in which a photosensitive layer is formed on the intermediate layer (i.e., resin) using a solvent, the resin is preferably hardly soluble in a typically used organic solvent. Specific examples of such resins include water soluble resins, for example, polyvinyl alcohol, casein, and sodium polyacrylate, alcohol soluble resins, for example, copolymerized nylon and methoxymethylized nylon and curing resins which form a three-dimensional mesh structure, for example, polyurethane, melamine resins, phenol resins, alkyd-melamine resins and epoxy resins. In addition, fine powder pigments of metal oxides exemplified by titanium oxide, silica, alumina, zirconium oxide, tin oxide and indium oxide can be added to the undercoating layer to prevent the occurrence of moiré, reduce the residual voltage and so on.

The undercoating layer can be formed by using the same solvents and the same coating methods as those for the photosensitive layer. Furthermore, silane coupling agents, titanium coupling agents and chromium coupling agents can be used in the undercoating layer. In addition, $Al_2O_3$ formed by anodic oxidization, organic compounds, for example, polyparaxylylene (parylene), which are formed by a vacuum thin layer manufacturing method, and inorganic materials, for example, $SiO_2$, $SnO_2$, $TiO_2$, ITO and $CeO_2$ can be also used in the undercoating layer. The thickness of the undercoating layer is suitably from 0 to 5 μm.

In addition, in the present invention, to improve the anti-environment properties, especially to prevent the reduction in the sensitivity and the rise in the residual voltage, an anti-oxidizing agent can be added to each layer of the protective layer, the charge generating layer, the charge transport layer, the undercoating layer, the intermediate layer, etc.

Specific examples of the anti-oxidizing agents for use in the present invention include, but are not limited to, the following:

Phenol-based Compounds:

2,6-di-t-butyl-p-cresol, butylated hydroxyl anisole,
2,6-di-t-butyl-4-ethylphenol,
stearyl-β-(3,5-di-t-butyl-4-hydroxyphehyl)propionate,
2,2'-methylene-bis-(4-methyl-6-t-butylphenol),
2,2'-methylene-bis-(4-ethyl-6-t-butylphenol),
4,4'-thiobis-(3-methyl-6-t-butylphenol),
4,4'-butylidenebis-(3-methyl-6-t-butylphenol),
1,1,3-tris-(2-methyl-4-hydroroxy-5-t-butylphenyl)butane,
1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane,
bis[3,3'-bis(4'-hydroxy-T-t-butylphenyl)butyric acid]glycol ester and tocopherol;

Paraphenylene Diamines:

N-phenyl-N' isopropyl-p-phenylene diamine,
N,N'-di-(sec-butyl)-p-phenylene diamine,
N-phenyl-N-sec-butyl-p-phenylene diamine,
N,N'-di-isopropyl-p-phenylene diamine, and
N,N'-dimethyl-N,N'-di-(t-butyl)-p-phenylene diamine;

Hydroquinones:

2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, and 2-(2-octadecenyl)-5-methyl hydroquinone;

Organic Sulfur Compounds:

dilauryl-3,3-thiodipropionate, distearyl-3,3'-thiodipropionate,
dimyristyl-3,3'-thiodipropionate,
ditetradecyle-3,3'-thiodipropionate, penta-erythritol tetrakis (3-laurylthiopropionate; and Organic Phosphorous Compound:

triphenyl phosphate, tris(nonylphenyl)phosphite, tri(dinonylphenyl)phosphite, tris(2-ethylhexyl)phosphite, tridecylphosphite, tris(tridecyl)phosphite, dinphenyl mono(2-ethylhexyl)phosphite, diphenyl monodecyl phosphite, tris(2,4,di-t-butylphenyl) phosphite, distearylpentaerythritol diphosphite, bis(2,4,di-t-butylphenyl)pentaerythritol phosphite, 2,2-methylenebis(4,6-di-t-butylphenyl)octyl phosphite, tetrakis(2,4-di-t-butylphenyl)-4,4'-biphenylene-di-phosphite, dilaurylhydrogen phosphite, diphenyl hydrogen phosphite, tetraphenyl dipropylene glycol diphosphite, tetraphenyltetra(tridecyl)pentaerythritol tetraphosphite, tetra (tridecyl)-4,4' isopropylidene diphenyl diphosphite, bis (nonylphenyl)pentaerythritol diphosphite, and hydrogenerated bisphenol A pentaerythritol phosphite polymers.

These compounds are known as anti-oxidants for rubber, plastic, oils and products thereof are easily available in the market.

These compounds are known as anti-oxidants for rubber, plastic, oils and products thereof are easily available in the market.

In the present invention, by containing a phosphorous anti-oxidizing agent, the residual image caused by a fatigued image bearing member can be reduced. The mechanism of this is not clear but is inferred that since a phosphorous anti-oxidizing agent has a higher oxidization energy than other anti-oxidizing agent, the anti-oxidization effect is not lost during UV irradiation and is maintained thereafter.

The addition amount of the anti-oxidizing agent in the present invention is from 0.01 to 10% by weight based on the total weight of the layer to which the anti-oxidization is added.

Image Formation Method and Device

Next, the image formation method and the image forming apparatus of the present invention are described in detail with reference to the accompanying drawings.

The image forming method and the image forming apparatus of the present invention use the image bearing member having a charge transport cross linking surface layer having a smooth surface and a low surface energy property and perform image forming processes of, for example, charging the image bearing member, irradiating the image bearing member to form a latent electrostatic image thereon, developing the latent electrostatic image with toner, transferring the toner image to an image bearing body (transfer medium), fixing the image and cleaning the surface of the image bearing member. The method in which a latent electrostatic image is directly transferred to a transfer medium followed by the development thereof does not necessarily have the processes mentioned above relating to the image bearing member.

Figure 2:
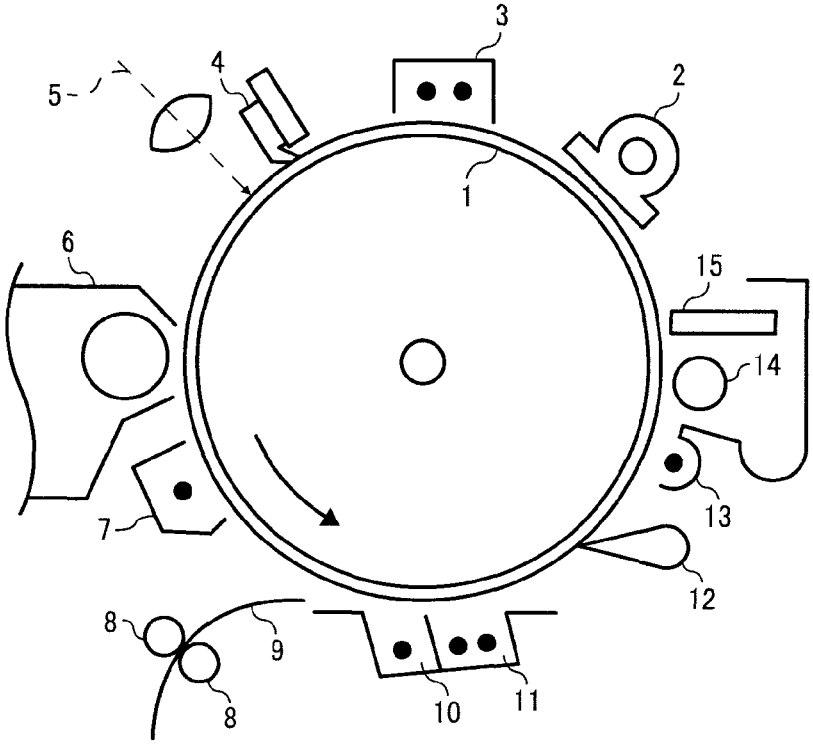
FIG. 2 is a diagram illustrating an example of the image forming apparatus of the present invention.

FIG. 2 is a schematic diagram illustrating an example of the image bearing member. A charging device 3 is used as the charging device to uniformly charge the image bearing member 1. Also, known charging devices, for example, a corotron device, a scorotron device, a solid discharging element, a needle electrode device, a roller charging device and an electroconductive brush device, can be used.

Next, an image irradiation portion 5 is used to faun a latent electrostatic image on the image bearing member 1 which is uniformly charged. As the light source, typical luminescent materials, for example, a fluorescent lamp, a tungsten lamp, a halogen lamp, a mercury lamp, a sodium lamp, a luminescent diode (LED), a semi-conductor laser (LD) and electroluminescence (EL) can be used. Various kinds of filters, for example, a sharp cut filter, a band pass filter, an infrared cut filter, a dichroic filter, a coherency filter and a color conversion filter can be used to irradiate the image bearing member 1 with light having only a desired wavelength.

Next, to visualize a latent electrostatic image formed on the image bearing member 1, a developing unit 6 is used. As the developing method, there are a single component development method and a two component development method which use a dry toner and a wet development method which uses a wet toner. When the image bearing member 1 is positively (negatively) charged and image irradiation is performed, a positive (negative) latent electrostatic image is formed on the surface of the image bearing member 1. When this positive (negative) latent electrostatic image is developed with a toner (electric detecting particulates) having a negative (positive) polarity, a positive image is obtained. When the image is developed with a toner having a positive (negative) polarity, a negative image is obtained.

Next, a transfer charging device 10 is used to transfer the visualized toner image on the image bearing member 1 to a transfer medium 9. In addition, to perform a good transferring, a charging device 7 can be used prior to transferring. As these transfer devices, an electrostatic transfer system using a transfer charging device or a bias roller, a mechanical transfer system using an adhesive transfer method or a pressure transfer method, and a magnetic transfer system can be used. As the electrostatic transfer system, the same device as the charging device mentioned above can be used.

Next, as a device to separate the transfer medium 9 from the image bearing member 1, a separation charging device 11 and a separation claw 12 are used. As other separating devices, electrostatic absorption guiding separation, side end belt separation, front end grip transfer, curvature separation, etc. can be used. As the separation charging device 11, the same device as the charging device mentioned above can be used.

Next, after transferring, to remove the toner remaining on the image bearing member 1, a fur brush 14 and a cleaning blade 15 are used. In addition, to effectively perform cleaning, a charging device 13 can be used prior to cleaning. Other cleaning devices, for example, a web-system device and a magnet brush system device can be also used. These cleaning devices can be used alone or in combination.

Next, if desired, a discharging device is used to remove the latent electrostatic image on the image bearing member 1. A discharging lamp 2 and a discharging charger can be used as the discharging device. The same devices as the irradiation light sources and the charging devices can be used therefor.

In addition to those mentioned above, known devices can be used in the processes of scanning originals, paper feeding, fixing images, discharging recording media, etc., which are performed not in the vicinity of the image bearing member 1.

The image forming method and the image forming apparatus of the present invention use the image bearing member of the present invention in the image formation device described above.

Figure 3:
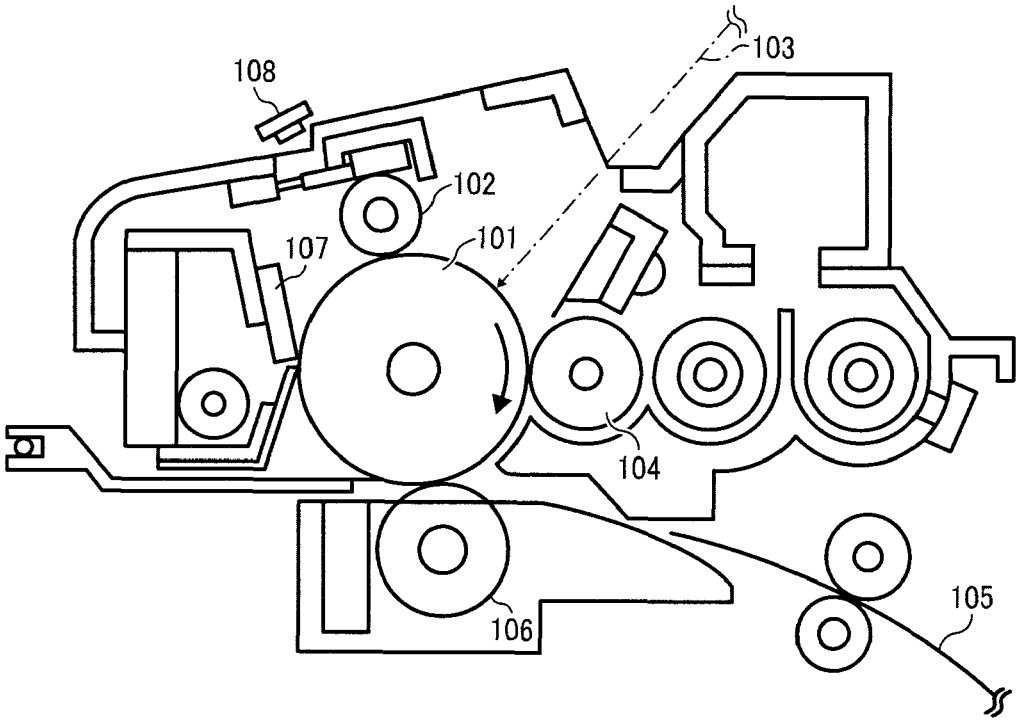
FIG. 3 is a diagram illustrating an example of the process cartridge for the image forming apparatus of the present invention.

This image formation device can be fixedly implemented in a photocopier, a facsimile machine or a printer and also detachably incorporated therein as a form of a process cartridge. FIG. 3 is a diagram illustrating an example of the process cartridge.

A process cartridge for use in the image formation is a device (part) which includes an image bearing member 101 and at least one of a charging device 102, an irradiation device 103, a development device 104, a transfer device 106, a cleaning device 107 and a discharging device (not shown) and detachably attachable to the main body of an image forming apparatus.

Figure 4:
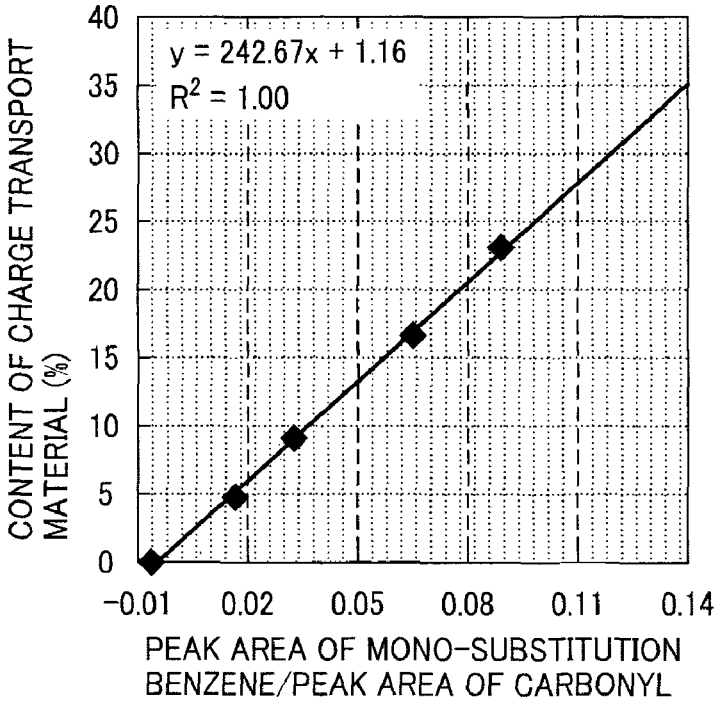
FIG. 4 is a diagram illustrating an example of analytical curve to identify the sneaking amount of the charge transport material to the protective layer.

The image formation process by the process cartridge illustrated in FIG. 4 is: while the image bearing member 101 is rotated in the direction indicated by an arrow, the image bearing member 101 is charged with the charging device 102 and irradiated by an irradiating device 103 to form a latent electrostatic image corresponding to the irradiation image on the surface of the image bearing member 101; the latent electrostatic image is developed with toner by the developing device 104; the toner image is transferred to a transfer medium 105 with the transfer device 106; the transferred image is then printed out; On the other hand, the surface of the image bearing member 101 is cleaned after transfer by the cleaning device 107 and discharged by the discharging device (not shown); and all the operations mentioned above continues in a repeated manner.

According to the present invention, there is provided a process cartridge for use in image formation which integrally includes the image bearing member having a charge transport polymer layer and a protective layer and at least one of a charging device, a developing device, a transfer device, a cleaning device and a discharging device.

As apparent from the description above, the image bearing member of the present invention can be applied not only to an a photocopier using the electrophotographic system, but also widely to the applied electrophotographic field including, for example, a laser beam printer, a CRT printer, an LED printer, a liquid crystal printer, and laser plate making.

Synthesis Method of Illustrated Compound No. 1

The compound having a charge transport structure for use in the present invention can be synthesized by, for example, Japanese Patent No. 3164426. An example of the synthesizing method is described below.

(1) Synthesis of Hydroxy Group-Substituted Triarylamine Compound (Represented by Chemical Structure B Below)

240 ml of sulfolane is added to 113.85 g (0.3 mole) of a methoxy group-substituted triarylamine compound {(represented by the following chemical structure (A)), and 138 g (0.92 mole) of sodium iodide. The resultant is heated to 60° C. in nitrogen gas stream. 99 g (0.91 mole) of trimethylchlorosilane is dropped to the resultant solution in one hour. Thereafter, the solution is stirred for 4.5 hours at around 60° C. and the reaction is terminated. To the reaction liquid, approximately 1,500 ml of toluene is added, and the reaction liquid is cooled down to the room temperature followed by repetitive washing with water and a sodium carbonate aqueous solution. Then, the solvent is removed from the toluene solution, and the solution is purified by column chromatography (absorption medium: silica gel; developing solvent: toluene:ethyl acetate=20:1). Cyclohexane is added to the obtained cream-colored oil to precipitate crystal. 88.1 g (yield constant: 80.4%) of white-color crystal represented by the following chemical structure (B) is thus obtained.

Melting point: 64.0° C. to 66.0° C.

Element analytical value: (%)

TABLE 1

| | C | H | N |
|---|---|---|---|
| Measured value | 85.06 | 6.41 | 3.73 |
| Calculated value | 85.44 | 6.34 | 3.83 |

Chemical structure (A)

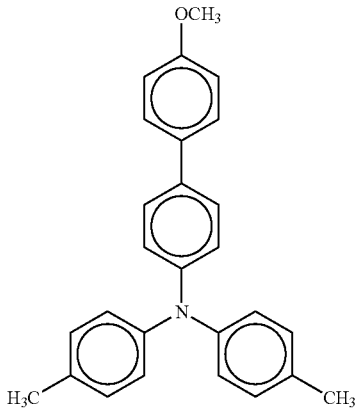

Chemical structure (A)

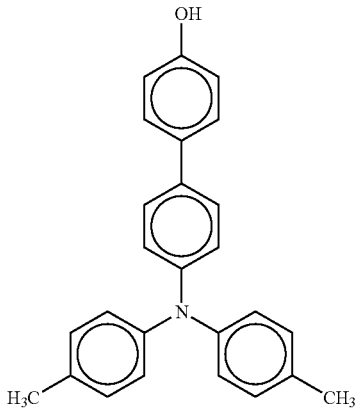

(2) Synthesis of Triarylamine Group-Substituted Acrylate Compound (Illustrated Compound No. 1)

82.9 g (0.227 mole) of the hydroxy group-substituted triarylamine compound obtained in the (1) (Chemical structure (B)) is dissolved in 400 ml of tetrahydrofuran, and a sodium hydroxide solution (NaOH: 12.4 g, water: 100 ml) is dropped into the dissolved solution in nitrogen gas stream. The solution is cooled down to 5° C., and 25.2 g (0.272 mole) of acrylic acid chloride is dropped thereto in 40 minutes. Thereafter, the solution is stirred for 3 hours at 5° C., and the reaction is terminated. The reaction liquid is poured to water and extracted using toluene. The extract is repetitively washed with a sodium hydrogen carbonate aqueous solution and water. Thereafter, the solvent is removed from the toluene solution, and the solution is purified by column chromatography (absorption medium: silica gel; developing solvent: toluene). Then, n-hexane is added to the obtained colorless oil to precipitate crystal. 80.73 g (yield constant: 84.8%) of white-color crystal of Compound Example No. 1 illustrated above is obtained.

Melting point: 117.5° C. to 119.0° C.

Element analytical value: (%)

TABLE 2

| | C | H | N |
|---|---|---|---|
| Measured value | 83.13 | 6.01 | 3.16 |
| Calculated value | 83.02 | 6.00 | 3.33 |

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

To the surface of an aluminum cylinder having an outer diameter of 30 mm, the liquid application for an undercoating layer, the liquid application for a charge generating layer and a liquid application for a charge transport layer of the following composition, are sequentially applied by a dip coating method and dried to form an undercoating layer having a thickness of 3.5 μm, a charge generating layer having a thickness of 0.2 μm, and a charge transport layer having a thickness of 22 μm.

| Liquid application for Undercoating Layer | |
|---|---|
| Alkyd resin (Beckozole 1307-60-EL, available from Dainippon Ink and Chemicals, Inc.) | 6 parts |
| Melamine resin (Super-beckamine, G-821-60, manufactured by Dainippon Ink and Chemicals, Inc.) | 4 parts |
| Titanium oxide (CR-EL, manufactured by Ishihara Sangyo Kaisha Ltd.) | 40 parts |
| Methylethylketone | 50 parts |

| Liquid application for Charge Generating Layer | |
|---|---|
| Bis-azo pigment represented by the following Chemical structure (C) | 2.5 parts |

Chemical structure (C)

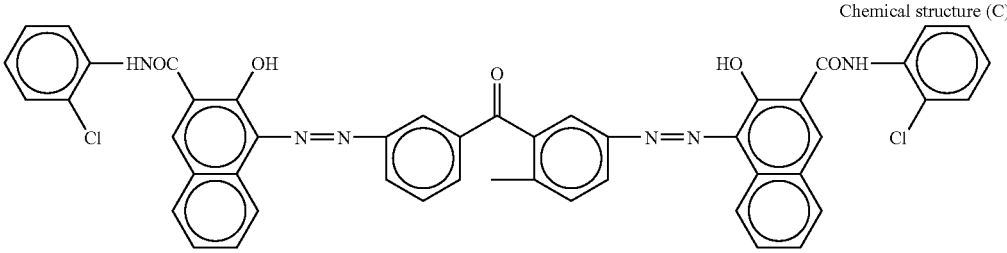

| | |
|---|---|
| Polyvinylbutyral (XYHL, manufactured by Union Carbide Corp.) | 0.5 parts |
| Cyclohexanone | 200 parts |
| Methylethylketone | 80 parts |

| Liquid application for Charge Transport Layer | |
|---|---|
| Bisphenol Z type polycarbonate (PANLITE TS-2050, manufactured by Teijin Chemicals, Ltd.) | 10 parts |

-continued

| Liquid application for Charge Transport Layer | |
|---|---|
| Charge transport material represented by the following chemical structure (D) | 7 parts |

Chemical structure (D)

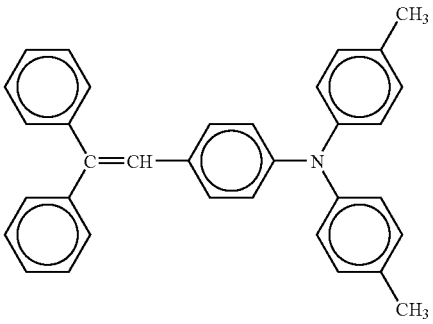

| | |
|---|---|
| Tetrahydrofuran | 100 parts |
| Tetrahydrofuran solution of 1% silicone oil (KF50-100CS, manufactured by Shin-Etsu Chemical Co., Ltd.) | 1 part |

The liquid application for the protective layer having the following recipe is applied to the charge transport layer by a spray coating method. The image bearing member is irradiated with light by a UV lamp system (Model F600S: Model 1600M for the light source and Model P600M for the power source, manufactured by Fusion Corp.) under the following conditions (lamp power: 160 W/cm; Kind of Lamp; V bulb; Number of lamps and arrangement: 2 lamps in serial arrangement; Wavelength: 365 nm; Luminous intensity: at least 300 mW/cm$^2$; Irradiation time: 30 seconds to the surface of the image bearing member; Surface temperature of the image bearing member: Not higher than 70° C. by cooling with water). Furthermore, the image bearing member is dried at 150° C. for 30 minutes to form a protective layer having a thickness of 10 μm. Two image bearing members of the present invention are thus manufactured. The luminous intensity of light having a wavelength of 365 nm is measured by an accumulated UV meter (UIT-150, manufactured by Usio Inc.) and a separate type detector (UVD-5356, manufactured by Usio Inc.).

| Liquid Application for Protective Layer | |
|---|---|
| Radical polymerizable compound having a charge transport structure (Illustrated compound No. 1: molecular weight: 419; Number of functional groups: 1) | 10 parts |
| Radical polymerizable monomer having no charge transport structure | 10 parts |
| Trimethylol propantriacrylate (KAYARAD TMPTA, manufactured by Nippon Kayaku Co., Ltd.) | 5 parts |
| Caprolactone modified dipentaerythritol hexaacrylate (KAYARAD DPCA-120, manufactured by Nippon Kayaku Co., Ltd.) | 5 parts |
| Optical polymerization initiator (IRGACURE 184: molecular weight: 204, manufactured by Nippon Kayaku Co., Ltd.) | 1 part |
| Solvent (Tetrahydrofuran) | 100 parts |

| Measuring of Charge Transport Material Contained in Charge Transport | |
|---|---|
| Layer in Protective Layer at Depth of 2 μm from Surface of Charge transport Layer | |
| Making Analytical Curve | |
| Sample liquid application A for analytical curve | |
| Illustrated compound No. 1 | 50 parts |
| Methyl methacrylate monomer (manufactured by Wako Pure Chemical Industries, Ltd.) | 50 parts |
| Tetrahydrofuran | 400 parts |

Sample Liquid Application B for Analytical Curve

Sample liquid application B for analytical curve is prepared in the same manner as in manufacturing Sample liquid application A for analytical curve except that 5 parts of the charge transport material represented by the Chemical structure (D) illustrated above Sample Liquid Application C for Analytical Curve Sample liquid application C for analytical curve is prepared in the same manner as in manufacturing Sample liquid application B for analytical curve except that the charge transport material is increased to 10 parts.

Sample Liquid Application D for Analytical Curve

Sample liquid application D for analytical curve is prepared in the same manner as in manufacturing Sample liquid application B for analytical curve except that the charge transport material is increased to 20 parts.

Sample Liquid Application E for Analytical Curve

Sample liquid application E for analytical curve is prepared in the same manner as in manufacturing Sample liquid application B for analytical curve except that the charge transport material is increased to 30 parts.

Each of the sample liquid applications A to E for analytical curve is applied to an aluminum plate by a blade followed by heating at 130° C. for 30 minutes for drying. Thus, samples A to E for analytical curve having a layer thickness of 5 μm are obtained.

Samples A to E for analytical curve are measured by using ATR method of FT-IR with a device of FT-IR Nicolet 380 (Crystal: Si) for general analysis, manufactured by Thermo Electron Co., Ltd. The analytical curve is made based on the peak area ratio of the absorption of carbonyl (1783.8-1664.2 $cm^{-1}$) contained in the illustrated compound No. 1 and methyl methacrylate monomer to the absorption of monosubstituted benzene (713.5-688.42 $cm^{-1}$). The analytical curve is illustrated in FIG. 4.

To apply the analytical curve to the protective layer, carbonyl equivalent is converted. Conversion of carbonyl equivalent is calculated by the ratio of carbonyl equivalent per particular amount using number of carbonyl groups/molecular weight per unit molecule. Molecular Weight and Number of Carbonyl Groups per Unit Molecule Contained in Protective Layer Composition and Material Contained in Sample Analytical Curve

TABLE 3

| | Molecular weight | Number of carbonyl groups per unit molecule |
|---|---|---|
| Methyl methacrylate | 100 | 1 |
| DPCA120 | 1948.3 | 18 |
| TMPTA | 296.32 | 3 |
| Illustrated Compound No. 1 | 419.53 | 1 |

Content of Carbonyl per 1 g of the Protective Layer

TABLE 4

| | Illustrated Compound No. 1 | TMPTA | DPCA120 | Total |
|---|---|---|---|---|
| Weight ratio | 0.5 | 0.25 | 0.25 | 1 |
| Carbonyl ratio | 0.001192 | 0.002531 | 0.00231 | 0.006033 |

Content of Carbonyl per 1 g of Sample Analytical Curve

TABLE 5

| | Illustrated compound No. 1 | Methyl methacrylate | Total |
|---|---|---|---|
| Weight ratio | 0.5 | 0.5 | 1 |
| Carbonyl ratio | 0.001192 | 0.005 | 0.006192 |

Conversion of carbonyl equivalent is based on (Content of carbonyl in the protective layer)/Content of carbonyl in sample for analytical curve). In Example 1, the conversion coefficient is 1.026 (0.006192/0.006033).

Figure 5:
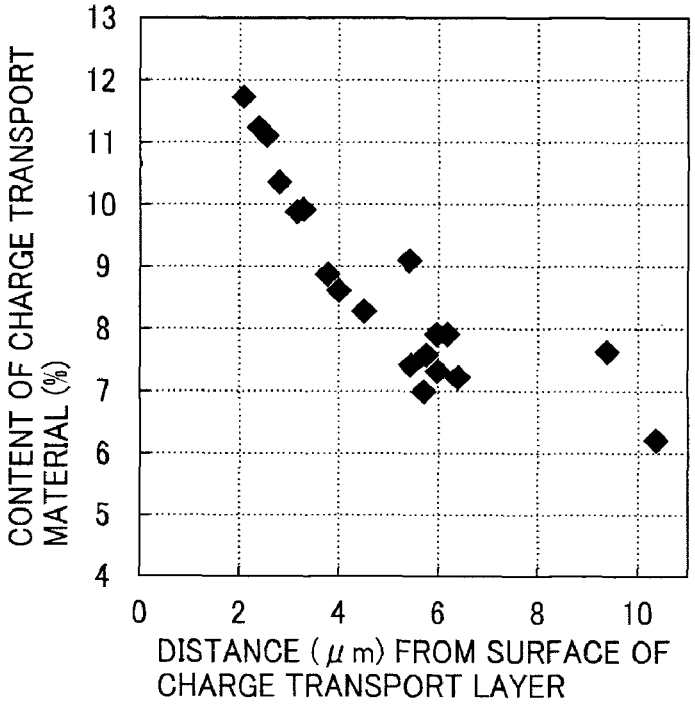
FIG. 5 is a diagram illustrating the content of the charge transport material in the protective layer by ATR (Attenuated Total Reflection) method of FT-IR.

Next, while one of the manufactured two image bearing members having a protective layer is rotated at a constant speed, a wrapping film (manufactured by Sumitomo 3M) is made in contact with the surface of the image bearing member for abrasion. The content of the charge transport material in the protective layer is measured by ATR method of FT-IR. The measured result is shown in FIG. 5. The density of the charge transport material in the protective layer is 11.8% at a depth of 2 μm from the surface of the charge transport layer.

Content of Charge Transport Material at Surface of Charge Transport Layer Before Protective Layer is Formed The content of the charge transport material at the surface of the charge transport layer before the protective layer is formed is obtained as follows: Prepare THF solution having a solid portion density of 20% containing 1 part, 3 parts and 5 parts of the charge transport material in 10 parts of bisphenol Z type polycarbonate; Make an analytical curve from a sample prepared by blade application to an aluminum plate based on the intensity ratio of the single peak (1565-1614 $cm^{-1}$) of the charge transport material and the single peak (around 1741-1820 $cm^{-1}$) of the binder resin by using ATR method of FT-IR; and measure the content of the charge transport material at the surface of the charge transport layer before the protective layer is formed. The measured result using this analytical curve is 23%.

Measuring of Glass Transition Temperature of Charge Transport Layer

The glass transition temperature of the charge transport layer is measured by DSC after the charge transport layer is cut from the electroconductive substrate before the protective layer is formed. The glass transition temperature of the charge transport layer is measured by ThermoPlus DSC8230, manufactured by Rigaku Corporation. The The glass transition temperature of the charge transport layer is 84° C.

Example 2

An image bearing member is manufactured in the same manner as in Example 1 except that a charge transport layer having a layer thickness of 5 μm having the following recipe is coated on the charge transport layer of Example 1 by spray coating and a protective layer is formed.

| Liquid application for Charge Transport Layer | |
|---|---|
| Bisphenol Z type polycarbonate (PANLITE TS-2050, manufactured by Teijin Chemicals Ltd.) | 10 parts |
| Charge transport material represented by the Chemical structure (D) illustrated above | |
| Cyclohexanone | 100 parts |
| Tetrahydrofuran solution of 1% silicone oil (KF50-100CS, manufactured by Shin-Etsu Chemical Co., Ltd.) | 1 part |

Example 3

An image bearing member is prepared in the same manner as in Example 1 except that the charge transport layer of Example 1 is abraded with a wrapping film for 2 μm and then a protective layer is formed and dried at 130° C. for 30 minutes.

Example 4

An image bearing member is manufactured in the same manner as in Example 1 except that the liquid application for the charge transport layer is changed to the following and the protective layer is formed and dried at 130° C. for 30 minutes:

| Liquid application for Charge Transport Layer | |
|---|---|
| Bisphenol Z type polycarbonate (PANLITE TS-2050, manufactured by Teijin Chemicals Ltd.) | 10 parts |
| Charge transport material represented by the chemical structure (D) illustrated above | |
| Tetrahydrofuran | 100 parts |
| Tetrahydrofuran solution of 1% silicone oil (KF50-100CS, manufactured by Shin-Etsu Chemical Co., Ltd.) | 1 part |

Example 5

An image bearing member is manufactured in the same manner as in Example 1 except that the liquid application for the protective layer is changed to the following:

| Liquid application for Protective Layer | |
|---|---|
| Radical polymerizable compound having a charge transport structure (Illustrated compound No. 1: molecular weight: 419; Number of functional groups: 1) | 10 parts |
| Radical polymerizable monomer having no charge transport structure | 10 parts |
| Trimethylol propantriacrylate (KAYARAD TMPTA, manufactured by Nippon Kayaku Co., Ltd.) | 5 parts |
| Caprolactone modified dipentaerythritol hexaacrylate (KAYARAD DPCA-120, manufactured by Nippon Kayaku Co., Ltd.) | 5 parts |
| Optical polymerization initiator (IRGACURE 184: molecular weight: 204, manufactured by Nippon Kayaku Co., Ltd.) | 1 part |
| Solvent (Tetrahydrofuran) | 100 parts |
| Phosphorous based anti-oxidizing agent represented by the following chemical structure (E) | 0.1 parts |

Chemical Structure (E)

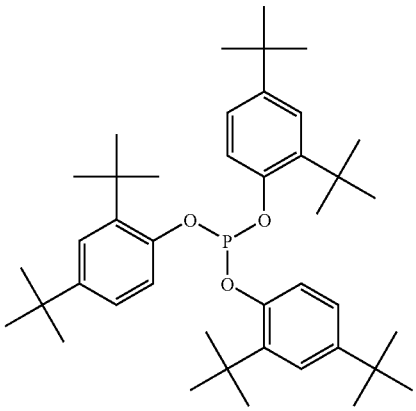

Comparative Example 1

An image bearing member is manufactured in the same manner as in Example 1 except that the drying temperature after the protective layer is formed is changed to 130° C.

Comparative Example 2

An image bearing member is manufactured in the same manner as in Example 1 except that the liquid application for the charge transport layer is changed to the following recipe and the drying temperature and time after the protective layer is formed are changed to 140° C. for 30 minutes.

| Liquid Application for Charge Transport Layer | |
|---|---|
| Bisphenol Z type polycarbonate (PANLITE TS-2050, manufactured by Teijin Chemicals Ltd.) | 10 parts |
| Charge transport material represented by the Chemical structure (D) illustrated above | |
| Tetrahydrofuran | 100 parts |
| Tetrahydrofuran solution of 1% silicone oil (KF50-100CS, manufactured by Shin-Etsu Chemical Co., Ltd.) | 1 part |

Comparative Example 3

An image bearing member is manufactured in the same manner as in Example 1 except that the liquid application for the protective layer is changed to the following:

| Liquid application for Protective Layer | |
|---|---|
| Radical polymerizable compound having a charge transport structure (Illustrated compound No. 1: molecular weight: 419; Number of functional groups: 1) | 10 parts |
| Radical polymerizable monomer having no charge transport structure | 10 parts |
| Trimethylol propantriacrylate (KAYARAD TMPTA, manufactured by Nippon Kayaku Co., Ltd.) | 5 parts |
| Caprolactone modified dipentaerythritol hexaacrylate (KAYARAD DPCA-120, manufactured by Nippon Kayaku Co., Ltd.) | 5 parts |
| Optical polymerization initiator (IRGACURE 184: molecular weight: 204, manufactured by Nippon Kayaku Co., Ltd.) | 1 part |
| Charge transport material represented by the Chemical structure (D) illustrated above | 2 parts |
| Solvent (Tetrahydrofuran) | 100 parts |

Comparative Example 4

An image bearing member is manufactured in the same manner as in Example 1 except that the protective layer of Example 1 is not provided.

Comparative Example 5

An image bearing member is manufactured in the same manner as in Example 2 except that the protective layer of Example 2 is not provided.

The density (%) of the charge transport material in the protective layer at a depth of 2 μm from the surface of the charge transport layer for the image bearing members of Examples 1 to 5 and Comparative Examples 1 to 3 is shown in Table 6.

TABLE 6

| | Density (%) of the charge transport material in the protective layer at a dept of 2 μm from the surface of the charge transport layer |
|---|---|
| Example 1 | 11 |
| Example 2 | 20 |
| Example 3 | 13 |
| Example 4 | 12 |
| Example 5 | 11 |
| Comparative Example 1 | 5 |
| Comparative Example 2 | 31 |
| Comparative Example 3 | 20 |

Next, the result is shown in table 7 when the manufacturing conditions of the image bearing members of Examples 1 to 5 and Comparative Examples 1 to 3 are assigned to the relationship (2).

TABLE 7

| | C (%) | T (° C.) | Tg (° C.) | T (min) | $C/100 \times (T - Tg) \times \log_{10}t$ |
|---|---|---|---|---|---|
| Example 1 | 23 | 150 | 84 | 30 | 22 |
| Example 2 | 5 | 150 | 60 | 30 | 74 |
| Example 3 | 33 | 130 | 84 | 30 | 22 |
| Example 4 | 29 | 130 | 78 | 30 | 22 |
| Example 5 | 23 | 150 | 84 | 30 | 22 |
| Comparative Example 1 | 23 | 130 | 84 | 30 | 16 |
| Comparative Example 2 | 60 | 140 | 54 | 30 | 76 |
| Comparative Example 3 | 23 | 150 | 84 | 30 | 22 |

The image bearing members of Examples 1 to 5 and Comparative Examples 1 to 3 manufactured as described above are installed into an image forming apparatus remodeled based on IMAGIO NEO C455 (manufactured by Ricoh Co., Ltd.) (AC non-contact roller system; image irradiation power source: 655 nm; no discharging system). Then, an actual machine test is performed with a run length of 3,000 rotations and a dark portion voltage of 700 (−V). The results are evaluated for anti-abrasion property and the residual image. The results are shown in Table 8. The layer thickness of the image bearing member is measured by using an eddy-current thickness measuring device (manufactured by Fisher Instrument Company).

Image Pattern for Residual Image Evaluation

Figure 6:
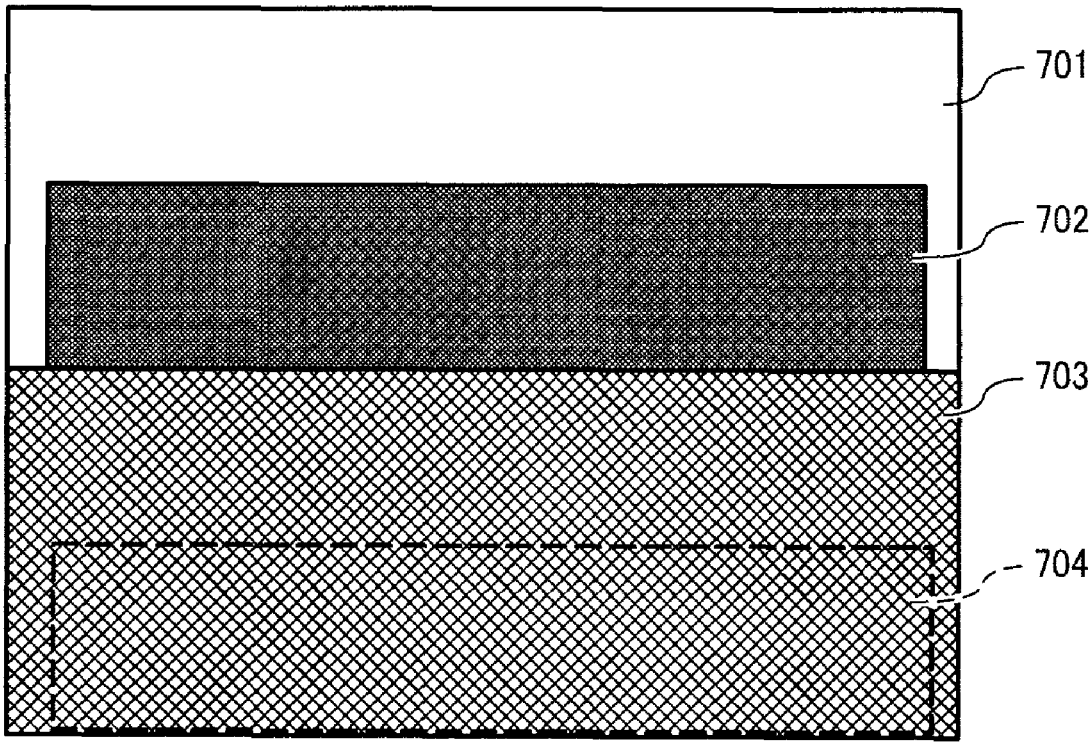
FIG. 6 is a diagram illustrating an image pattern for the residual image evaluation.

As the image pattern for evaluation for the residual image, the pattern illustrated in FIG. 6 is used. In FIG. 6, 701 represents a white portion, 702 represent a black solid portion, 703 represents a half tone portion, and 704 represents a portion in which a residual image ascribable to the black solid portion 702 appears.

Evaluation Method of Residual Image 10 images for the image pattern for the residual images are printed and the $10^{th}$ image is evaluated. An optical densitometer (X-Rite 508, manufactured by X-Rite Incorporated) is used for the evaluation of the residual image. In the image of the image pattern for the residual image evaluation, the density obtained by subtracting the density of the half tone portion 703 from the density of the portion 704 in which a residual image may appear is measured at 5 points and the average ΔID thereof is calculated. It is determined that when ΔID is not less than 0.030, the effect of the present invention is not sufficient.

TABLE 8

| | Abrasion amount (μm) after 3,000 rotation | Initial ΔID | ΔID after the running test |
|---|---|---|---|
| Example 1 | 0.6 | 0.005 | 0.025 |
| Example 2 | 0.6 | 0.004 | 0.022 |
| Example 3 | 0.6 | 0.005 | 0.023 |
| Example 4 | 0.5 | 0.005 | 0.022 |
| Example 5 | 0.5 | 0.005 | 0.008 |
| Comparative Example 1 | 0.6 | 0.091 | 0.101 |
| Comparative Example 2 | — | 0.006 | — |
| Comparative Example 3 | 0.6 | 0.008 | 0.025 |

With regard to the image bearing member of Comparative Example 2, a portion from the protective layer to the photosensitive layer is peeled off when the image bearing member is rotated 2,000 times and naturally the running test is stopped.

Next, the protective layer of the image bearing members of Examples 1 to 5 and Comparative Example 3 is abraded to the thickness of 2 μm by a wrapping film roll (manufactured by Sumitomo 3M). Then, the anti-abrasion property is evaluated for the image bearing members of Examples 1 to 5 and Comparative Examples 3 to 5 after the run length of 3,000 rotation for the image bearing members. The results are shown in Table 9.

TABLE 9

| | Abrasion amount (μm) after abrasion and the run length of 3,000 rotation |
|---|---|
| Example 1 | 0.3 |
| Example 2 | 0.3 |
| Example 3 | 0.4 |
| Example 4 | 0.6 |
| Example 5 | 0.4 |
| Comparative Example 3 | 1.9 |
| Comparative Example 4 | 2.1 |
| Comparative Example 5 | 2.2 |

As seen in the results, the image bearing members of the present invention are highly durable without residual images from the initial stage to after the run length of 3,000 rotation. Furthermore, with regard to the system in which the phosphorous based anti-oxidizing agent is set, there is no deterioration after the run length of 3,000 rotation compared to the initial stage. In addition, the protective layer of the image bearing member of the present invention is uniformly cured. On the other hand, the system in which the charge transport material of the charge transport layer is placed in the protective layer beforehand is good about the residual image but has bad curing inside the protective layer. Thus, this system has significantly the same anti-abrasion property as that of an image bearing member without a protective layer.

As seen in the description above, according to the present invention, an image baring member having a uniformly cured protective layer which is free from producing residual images in an image forming apparatus having no discharging device is provided while having an excellent combination of image stability and anti-abrasion property. Also, an image forming apparatus and a process cartridge having the image bearing member are provided.

This document claims priority and contains subject matter related to Japanese Patent Application No. 2007-174534, filed on Jul. 2, 2007, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image bearing member comprising:

an electroconductive substrate;

a charge generating layer located overlying the electroconductive substrate;

a charge transport layer located overlying the charge generating layer, the charge transport layer comprising a charge transport material; and a protective layer having a thickness of from 3 to 15 μm located overlying the charge transport layer, wherein the protective layer includes cross-linked material of a radical polymerizable monomer having a charge transport structure and a radical polymerizable monomer having no charge transport structure, and wherein a density of the charge transport material in the protective layer at a depth of 2 μm from a surface of the charge transport layer satisfies the following relationship (1):

$$10 \leqq (\text{Charge transport material})/\{(\text{Cured Radical polymerizable monomer having a charge transport structure})+(\text{Cured Radical polymerizable monomer having no charge transport structure})+(\text{Charge transport material})\}\times 100 \leqq 30 \qquad \text{Relationship (1).}$$

2. The image bearing member according to claim 1, wherein the protective layer is formed by application of a liquid application comprising the radical polymerizable monomer having a charge transport structure and the radical polymerizable monomer having no charge transport structure and curing of the liquid application by an optical energy irradiation device and the following relationship (2) is satisfied:

$$16 < C/100\times(T-Tg)\times\log_{10} t < 75 \qquad \text{Relationship (2),}$$

where T (° C.) represents a drying temperature in a range of from 100 to 160° C. after the protective layer is formed, t (min) represents a drying time in a range of from 30 to 240 minutes after the protective layer is formed, C (%) represents a content of the charge transport material at the surface of the charge transport layer in a range of from 33 to 70% by weight before the protective layer is formed, and Tg (° C.) represents a glass transition temperature of the charge transport layer.

3. The image bearing member according to claim 2, wherein the radical polymerizable monomer having no charge transport structure for use in formation of the protective layer has at least three radical polymerizable functional groups.

4. The image bearing member according to claim 2, wherein the radical polymerizable monomer having a charge transport structure for use in formation of the protective layer has one radical polymerizable functional group.

5. The image bearing member according to claim 2, wherein the radical polymerizable monomer having a charge transport structure for use in formation of the protective layer has a triaryl amine structure as the charge transport structure.

6. The image bearing member according to claim 2, wherein the radical polymerizable monomer having a charge transport structure and the radical polymerizable monomer having no charge transport structure have an acryloyloxy group or a methacryloyloxy group as the radical polymerizable functional group thereof.

7. The image bearing member according to claim 2, wherein only the radical polymerizable monomer having a charge transport structure has a charge transport structure in the liquid application.

8. The image bearing member according to claim 1, wherein the protective layer comprises a phosphorous based anti-oxidizing agent.

9. An image formation method comprising:

charging the image bearing member of claim 1;

irradiating the image bearing member to form a latent electrostatic image thereon;

developing the latent electrostatic image to form a developed image with a developing agent; and transferring the developed image to a recording medium.

10. An image forming apparatus comprising:

the image bearing member of claim 1;

a charging device configured to charge the image bearing member;

an irradiation device configured to irradiate the image bearing member with light to form a latent electrostatic image thereon;

a developing device configured to develop the latent electrostatic image with a developing agent to form a developed image;

a transferring device configured to transfer the developed image to a recording medium.

11. A process cartridge detachably attachable to an image forming apparatus comprising:

the image bearing member of claim 1, and at least one device selected from the group consisting of a charging device, a developing device, a cleaning device and a transfer device.

12. A method of forming an image bearing member comprising:

forming a charge generating layer located overlying an electroconductive substrate;

forming a charge transport layer located overlying the charge generating layer, the charge transport layer comprising a charge transport material; and forming a protective layer having a thickness of from 3 to 15 μm located overlying the charge transport layer by application of a liquid application comprising a radical polymerizable monomer having a charge transport structure and a radical polymerizable monomer having no charge transport structure and curing of the liquid application by an optical energy irradiation device, wherein a density of the charge transport material in the protective layer at a depth of 2 μm from a surface of the charge transport layer satisfies the following relationship (1):

$$10 \leqq (\text{Charge transport material})/\{(\text{Radical polymerizable monomer having a charge transport structure})+(\text{Radical polymerizable monomer having no charge transport structure})+(\text{Charge transport material})\}\times 100 \leqq 30 \qquad \text{Relationship (1)},$$

and wherein the following relationship (2) is satisfied:

$$16 < C/100 \times (T-Tg) \times \log_{10} t < 75 \qquad \text{Relationship (2)},$$

where T (° C.) represents a drying temperature in a range of from 100 to 160° C. after the protective layer is formed, t (min) represents a drying time in a range of from 30 to 240 minutes after the protective layer is formed, C (%) represents a content of the charge transport material at the surface of the charge transport layer in a range of from 33 to 70% by weight before the protective layer is formed, and Tg (° C.) represents a glass transition temperature of the charge transport layer.

* * * * *